US012578107B2

(12) United States Patent
Kim et al.

(10) Patent No.: US 12,578,107 B2
(45) Date of Patent: Mar. 17, 2026

(54) HYGIENE MANAGEMENT DEVICE FOR ENTRANCE HALL AND CONTROL METHOD OF SAME

(71) Applicant: LG ELECTRONICS INC., Seoul (KR)

(72) Inventors: Taihong Kim, Seoul (KR); Hyunbyung Cha, Seoul (KR); Hyunsun Yoo, Seoul (KR); Joohyeon Oh, Seoul (KR); Byoungjoonphilip Han, Seoul (KR); Sang Yoon Lee, Seoul (KR); HyunJu Kim, Seoul (KR); Chul Bae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 988 days.

(21) Appl. No.: 17/550,700

(22) Filed: Dec. 14, 2021

(65) Prior Publication Data

US 2022/0186957 A1 Jun. 16, 2022

(30) Foreign Application Priority Data

Dec. 14, 2020 (KR) ..... 10-2020-0174512
Feb. 4, 2021 (KR) ..... 10-2021-0015905

(51) Int. Cl.

| | |
|---|---|
| ***F24F 9/00*** | (2006.01) |
| ***F24F 11/79*** | (2018.01) |
| ***F24F 13/072*** | (2006.01) |
| ***F24F 120/12*** | (2018.01) |

(52) U.S. Cl.
CPC ..... *F24F 9/00* (2013.01); *F24F 11/79* (2018.01); *F24F 13/072* (2013.01); *F24F 2009/007* (2013.01); *F24F 2120/12* (2018.01)

(58) Field of Classification Search
CPC ..... F24F 9/00; F24F 11/79; F24F 2009/007; B08B 5/02; B08B 15/02
See application file for complete search history.

(56) References Cited

U.S. PATENT DOCUMENTS

| | | | |
|---|---|---|---|
| 3,068,775 | A | 12/1962 | Zehnder |
| 3,097,587 | A | 7/1963 | Kurek |
| 6,015,342 | A | 1/2000 | Dennis |
| 10,532,119 | B2 | 1/2020 | Dombrowsky et al. |

(Continued)

FOREIGN PATENT DOCUMENTS

| | | | |
|---|---|---|---|
| CN | 203648916 U | * | 6/2014 |
| CN | 204503669 U | | 7/2015 |

(Continued)

*Primary Examiner* — Allen R. B. Schult
(74) *Attorney, Agent, or Firm* — Birch, Stewart, Kolasch & Birch, LLP

(57) ABSTRACT

A hygiene management device for an entrance hall and the control method of the same are proposed. The hygiene management device may be installed in an entrance space, and when a person is detected at a preset position, distance between an air discharger and the person may be detected. When the detected distance is within a reference distance, air may be discharged. In addition, an air discharge condition suitable for a person may be preset, and when the person enters the entrance hall, the person's face may be detected, and air may be discharged to the person according to the air discharge condition preset for the person.

17 Claims, 24 Drawing Sheets

(56) References Cited

U.S. PATENT DOCUMENTS

| | | | | |
|---|---|---|---|---|
| 10,641,517 | B2 * | 5/2020 | Song | G06V 40/28 |
| 11,083,815 | B1 | 8/2021 | Lee | |
| 2018/0369434 | A1 | 12/2018 | Callahan | |
| 2019/0234632 | A1 * | 8/2019 | Reeder | F24F 11/0001 |
| 2019/0321503 | A1 | 10/2019 | Warnell | |
| 2021/0252176 | A1 * | 8/2021 | Nam | F24F 11/30 |

FOREIGN PATENT DOCUMENTS

| | | | | |
|---|---|---|---|---|
| CN | 207285658 | U | | 5/2018 |
| CN | 108655109 | A | | 10/2018 |
| CN | 209465426 | U | | 10/2019 |
| CN | 111482296 | A | | 8/2020 |
| CN | 111720974 | A | | 9/2020 |
| CN | 211413001 | U | * | 9/2020 |
| GB | 1 527 907 | A | | 10/1978 |
| JP | S6310336 | B2 | * | 3/1988 |
| JP | 4109771 | B2 | | 7/2008 |
| JP | 2017-116231 | A | | 6/2017 |
| KR | 20-0396409 | Y1 | | 9/2005 |
| KR | 10-2009-0040630 | A | | 4/2009 |
| KR | 10-2010-0121201 | A | | 11/2010 |
| KR | 10-1030583 | B1 | | 4/2011 |
| KR | 10-2018-0082652 | A | | 7/2018 |
| KR | 10-2019-0055303 | A | | 5/2019 |
| KR | 10-2020-0004169 | A | | 1/2020 |
| KR | 10-2020-0046715 | A | | 5/2020 |
| KR | 10-2151990 | B1 | | 9/2020 |
| KR | 10-2020-0117286 | A | | 10/2020 |

* cited by examiner

HYGIENE MANAGEMENT DEVICE FOR ENTRANCE HALL AND CONTROL METHOD OF SAME

CROSS REFERENCE TO RELATED APPLICATIONS

This application claims the priority benefit of Korean Patent Application No. 10-2020-0174512 filed on Dec. 14, 2020 in the Republic of Korea and Korean Patent Application No. 10-2021-0015905 filed on Feb. 4, 2021 in the Republic of Korea, which are hereby incorporated by reference in their entirety for all purposes as if fully set forth herein.

BACKGROUND OF THE INVENTION

1. Field of the Invention

The present disclosure relates to a hygiene management device for an entrance hall and the control method of the same.

2. Description of the Background Art

Generally, in order to enter an indoor space from the outside, a person is required to go through an entrance hall, which separates the outside from the indoor space. For example, in the case of a house, a vestibule as an entrance hall is provided, and thus to enter the house, a person is required to go through the vestibule.

Recently, air quality outside is getting worse due to yellow dust or fine dust. In this situation, when yellow dust or fine dust enters an indoor space from the outside, the indoor space may be contaminated.

In a dense environment (i.e., small indoor space), such as an apartment, removing contaminants outside an entrance door may cause the contaminants to be transferred to surrounding people. Accordingly, before a person enters an indoor space, it is necessary to remove contaminants attached to the person in an entrance hall, such as a vestibule.

Technologies for preventing contaminants from being transferred to the indoor space are disclosed.

An air shower for a vestibule of a house is disclosed in (Patent Document 1) Korean Patent Application Publication No. 10-2009-0040630. In the related art disclosed in (Patent Document 1), air is showered on a person to remove contaminants, such as dust, on the clothing of the person.

However, the air applied to the person flows downward from the upper portion, so the air is applied mainly to the person's head and to the upper portion of the person's upper body and thus contaminants on the person's lower body and shoes are not properly removed. Furthermore, in the vestibule, an air introduction hole into which air is introduced is located at the side surface of a vestibule space, so contaminants, such as dust, remain on the bottom of the vestibule.

An air shower system for a vestibule is disclosed in (Patent Document 2) Korean Patent Application Publication No. 10-2020-0117286. In the air shower system disclosed in (Patent Document 2), in addition to the air shower, a photocatalytic lamp is installed on a ceiling to simultaneously remove contaminants, such as dust, and harmful substances, such as viruses, on the clothing of a person.

However, even the related art disclosed in (Patent Document 2), has the problems that contaminants, such as dust remain, on the bottom of a vestibule, and contaminants on a person's lower body and shoes are not properly removed due to the emission of light by the photocatalytic lamp from the ceiling.

A lighting-integrated air cleaning system for entrance space and a control method of the same are disclosed in (Patent Document 3) Korean Patent Application Publication No. 10-2020-0046715. In the related art disclosed in (Patent Document 3), a lighting fixture and an air cleaning system are integrated with each other such that contaminants are removed from a person in an entrance space such as a vestibule.

However, even in the related art disclosed in (Patent Document 3), a structure in which air is simply discharged downward from the upper side is integrated with the light fixture, and an air introduction hole is formed in the side surface of the entrance space, so contaminants in the entrance space are not properly removed.

An air shower apparatus integrated with a vestibule door is disclosed in (Patent Document 4) Korean Patent Application Publication No. 10-2019-0055303. In the related art disclosed in (Patent Document 4), a shower booth having a shower space thereinside is separately installed such that a person can remove contaminants in the shower booth.

However, the shower booth disclosed in (Patent Document 4) is separately partitioned in space inside a vestibule, and thus space occupied by an entire device inside the vestibule increases, so the air shower apparatus is not effective. Furthermore, the air shower apparatus has a simple structure in which air is discharged downward from an upper side, so ability with which the air shower apparatus removes contaminants decreases.

In addition, in the related arts disclosed in Patent Documents 1 to 4 described above, air is discharged without regard to a person's position and characteristics, so the effect of removing contaminants attached to the person decreases, and further, air is discharged even to unnecessary parts, so energy is wasted.

DOCUMENTS OF RELATED ART (Patent Document 1) Korean Patent Application Publication No. 10-2009-0040630

(Patent Document 2) Korean Patent Application Publication No. 10-2020-0117286

(Patent Document 3) Korean Patent Application Publication No. 10-2020-0046715

(Patent Document 4) Korean Patent Application Publication No. 10-2019-0055303

SUMMARY OF THE INVENTION

Accordingly, the present disclosure has been made keeping in mind the above problems occurring in the related art, and the present disclosure is intended to propose a hygiene management device for an entrance hall in which air is discharged to a person who enters an entrance space, such that contaminants attached to the person's body or clothes are removed.

The present disclosure is intended to propose a hygiene management device for an entrance hall in which contaminated air inside an entrance hall is introduced into the hygiene management device to be purified and then the purified air is discharged into a vestibule.

The present disclosure is intended to propose a hygiene management device for an entrance hall in which air is discharged to a position at which a person is located.

The present disclosure is intended to propose a hygiene management device for an entrance hall in which an air discharger discharges air according to a person's characteristics.

The present disclosure is intended to propose a hygiene management device for an entrance hall in which only an air discharger located within a predetermined distance from a person discharges air.

The present disclosure is intended to propose a hygiene management device for an entrance hall in which a person presets an air discharge condition suitable for the person.

The present disclosure is intended to propose a hygiene management device for an entrance hall in which when a person is located on a footrest (i.e., stands on a footrest), the person's face is detected and air is discharged according to a preset air discharge condition.

The present disclosure is intended to propose a hygiene management device for an entrance hall in which air is selectively discharged only to a portion required by a person according to the person's preset air discharge condition.

The present disclosure is intended to propose a hygiene management device for an entrance hall in which air is automatically discharged to a person by detecting (i.e., automatically detecting or manually detecting) the person going into the entrance hall.

The present disclosure is intended to propose a hygiene management device for an entrance hall in which when a person is located at a preset specific position, the person is detected and air is automatically discharged to the person.

The present disclosure is intended to propose a hygiene management device for an entrance hall in which air is not discharged directly to a person's face such that the person is prevented from having difficulty in breathing or feeling unpleasant due to the air discharge.

In a hygiene management device for an entrance hall and the control method of the same according to the present disclosure, an air discharger for discharging air in a specific space may be provided.

In the hygiene management device for an entrance hall and the control method of the same according to the present disclosure, multiple air dischargers may discharge air toward a person to a front rear of the person, to side of the person and in diagonal directions. Accordingly, contaminants attached to the person's clothes, body, and shoes may be effectively removed.

In the hygiene management device for an entrance hall and the control method of the same according to the present disclosure, the hygiene management device may include: a fan assembly configured to generate an air blowing force, a blowing duct through which air is transferred by the air blowing force generated by the fan assembly, the air discharger connected to the blowing duct and configured to discharge the air transferred from the blowing duct to a person, the air discharger having multiple discharge nozzle parts formed therein, a detector mounted to the air discharger and configured to detect a distance between the detector and the person, and a controller configured to control the air discharger such that the air discharger discharges air when the detected distance between the air discharger and the person is a reference distance or less.

In the hygiene management device for an entrance hall and the control method of the same according to the present disclosure, when a distance between the air discharger and a person is longer than the preset reference distance, the air discharger may not discharge air. Accordingly, the air discharger located far from a person may reduce the waste of air.

In the hygiene management device for an entrance hall and the control method of the same according to the present disclosure, when a person stands on a footrest mounted on the bottom of the entrance hall, the footrest supporting the person, the detector may detect the person such that the air discharger can automatically discharge air to the person.

In the hygiene management device for an entrance hall and the control method of the same according to the present disclosure, an air discharge condition suitable for each person may be preset, and when the person goes into the entrance hall, the detector may detect the person's face, such that the air discharger can discharge air to the person according to the preset air discharge condition.

That is, only some air dischargers may discharge air, during air discharge, only some discharge nozzle parts may discharge air, or a discharge nozzle part may discharge air by being tilted in a specific direction and at a specific angle.

In the hygiene management device for an entrance hall and the control method of the same according to the present disclosure, a damper assembly may be mounted to each of multiple discharge nozzle parts, such that the flow of air discharged through the discharge nozzle part is controlled by the damper assembly. When the damper assembly is driven, a damper located in the damper assembly may operate such that air discharge through the discharge nozzle part is performed or stopped.

In the hygiene management device for an entrance hall and the control method of the same according to the present disclosure, the discharge nozzle part may be tilted relative to the height direction of the air discharger to adjust the direction of discharged air. That is, a rotation shaft may be connected to the discharge nozzle part, and the discharge nozzle part may be configured to be tilted relative to the rotation shaft by a tilting drive part.

In the hygiene management device for an entrance hall and the control method of the same according to the present disclosure, when a person stands on the footrest, the fan assembly may operate and the inside air of an entrance space may be introduced into the footrest through multiple air introduction holes formed in the footrest.

In the hygiene management device for an entrance hall and the control method of the same according to the present disclosure, after air introduced into the footrest passes through multiple filters and the blowing duct, the air may be discharged back into the entrance space through the air discharger.

In the hygiene management device for an entrance hall and the control method of the same according to the present disclosure, when a preset time elapses after discharging air to a person standing on the footrest, the air discharger may stop discharging air.

In the hygiene management device for an entrance hall and the control method of the same according to the present disclosure, even before the preset time elapses, when no person on the footrest is detected, the air discharger may stop discharging air.

In the hygiene management device for an entrance hall and the control method of the same according to the present disclosure, the air discharger may include a plurality of air dischargers installed to be spaced apart from each other, and a detector may be mounted to each of the air dischargers. Accordingly, distance between the detector(s) and a person detected by the detector(s) may be distance between the air discharger(s) and the person.

In the hygiene management device for an entrance hall and the control method of the same according to the present disclosure, the discharge nozzle parts may be installed to be spaced apart from each other in the height direction of the air discharger. Accordingly, air may be discharged evenly to a person's entire body part.

In the hygiene management device for an entrance hall and the control method of the same according to the present disclosure, the detector may include: a first detector configured to detect a distance between the air discharger and a person, and a second detector configured to detect the person's face.

In the hygiene management device for an entrance hall and the control method of the same according to the present disclosure, when the second detector detects the person's face, the air discharger may discharge air to the detected person's face according to a pre-mapped air discharge condition for the person.

In the hygiene management device for an entrance hall and the control method of the same according to the present disclosure, during air discharge according to the air discharge condition, some discharge nozzle parts of the multiple discharge nozzle parts may discharge air by being tilted in preset directions and at preset angles (i.e., the discharged air may be discharged at preset angles).

In the hygiene management device for an entrance hall and the control method of the same according to the present disclosure, during air discharge according to the air discharge condition, only some discharge nozzle parts of the multiple discharge nozzle parts may discharge air (or nay number of discharge nozzle parts of the multiple discharge nozzle parts may discharge air).

In the hygiene management device for an entrance hall and the control method of the same according to the present disclosure, the air discharger may connect the blowing duct with the footrest and may be mounted to at least two corners of the footrest (among multiple corners of the footrest).

In the hygiene management device for an entrance hall and the control method of the same according to the present disclosure, the air discharger may be installed to be rotatable toward opposite sides between the blowing duct and the footrest. Accordingly, even if a person continues to move without stopping in the entrance space or is passing through the entrance space, the air discharger may discharge air toward the person.

The hygiene management device according to the present disclosure may have at least one of the following effects.

According to the present disclosure, air may be discharged to a person located at a preset position in the entrance space, thereby removing contaminants attached to a person's body or the person's clothes.

According to the present disclosure, the air dischargers of the side surfaces of the entrance space may discharge air to a person in the front rear of the person, to side of the person and in diagonal directions, thereby discharging a sufficient amount of air to a person's entire body portion and effectively removing contaminants from the person's body.

According to the present disclosure, air may be discharged toward a person in the entrance space which is blocked from an indoor area, thereby preventing external contaminants from being introduced in the indoor area.

According to the present disclosure, each of a plurality of air dischargers may be installed to be rotatable toward opposite sides, thereby discharging air toward a person regardless of a position at which the person is located.

According to the present disclosure, the discharge nozzle parts through which air is discharged may be mounted to the air discharger to be spaced apart from each other in the height direction of the air discharger, such that air is discharged to a person's entire body part regardless of the person's height, thereby improving the effect of removing contaminants.

According to the present disclosure, air may be discharged at a wind pressure (i.e., air pressure) and height appropriate for a person's height, thereby effectively removing contaminants on the person.

According to the present disclosure, in consideration of a person's height and physical condition (i.e., position within the hygiene management device, a person's size, etc.), air may not be discharged at a position at which a person is not located, but may be selectively discharged only to a necessary portion (i.e., a portion of the person that is contaminated), thereby preventing unnecessary air discharge and reducing waste of energy.

According to the present disclosure, the discharge nozzle part may be installed to adjust an upward/downward inclination, so air discharge may be performed in consideration of a person's face position (i.e., to avoid a person's face). Accordingly, the person may be prevented from having difficulty in breathing or feeling unpleasant due to the air discharge.

According to the present disclosure, the footrest may introduce the internal air of the entrance space into the footrest to purify the air, and the purified air may be discharged back to the inside of the entrance space, thereby managing the inside of the entrance space to be pleasant.

According to the present disclosure, when a person stands on a designated footrest, air may be automatically discharged to the person, thereby providing convenience.

According to the present disclosure, a person coming into the entrance hall may be detected, and air may be automatically discharged to the person.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
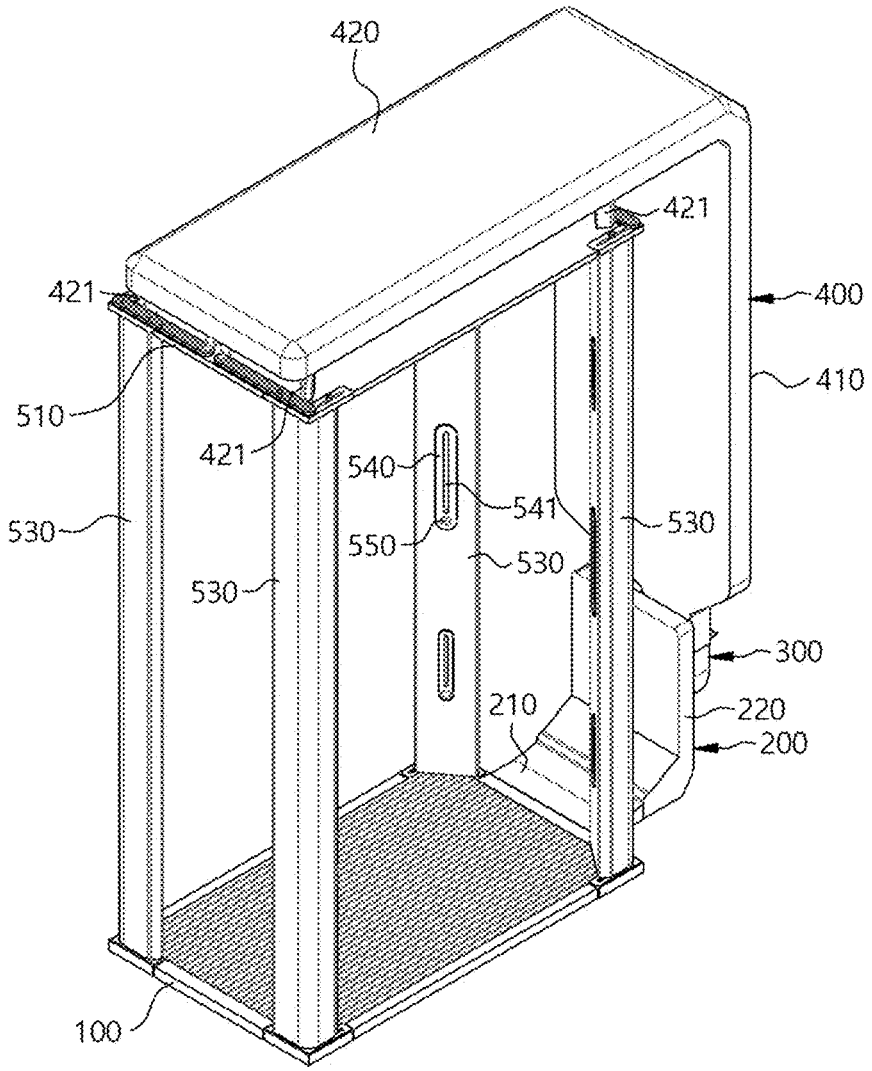
FIG. 1 is a perspective view illustrating the configuration of a hygiene management device for an entrance hall according to an embodiment of the present invention.
Figure 2:
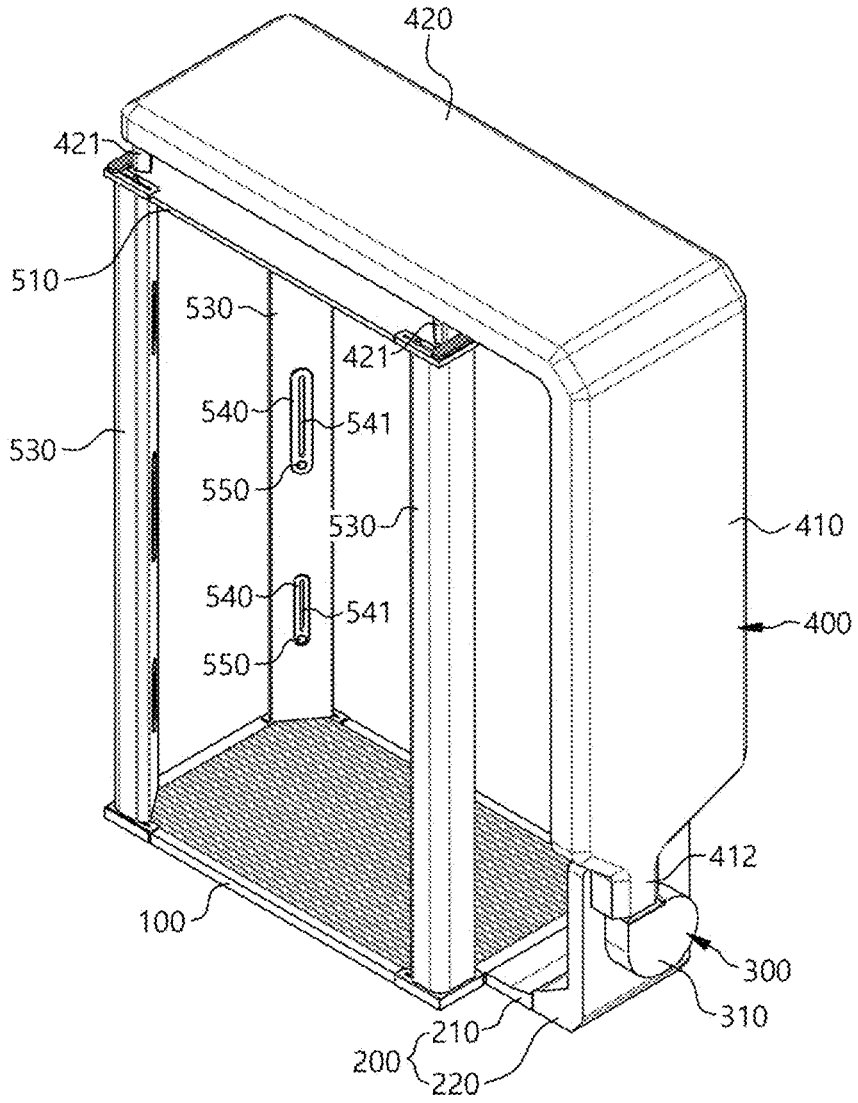
FIG. 2 is a rear perspective view illustrating the configuration of the hygiene management device according to an embodiment of the present invention.
Figure 3:
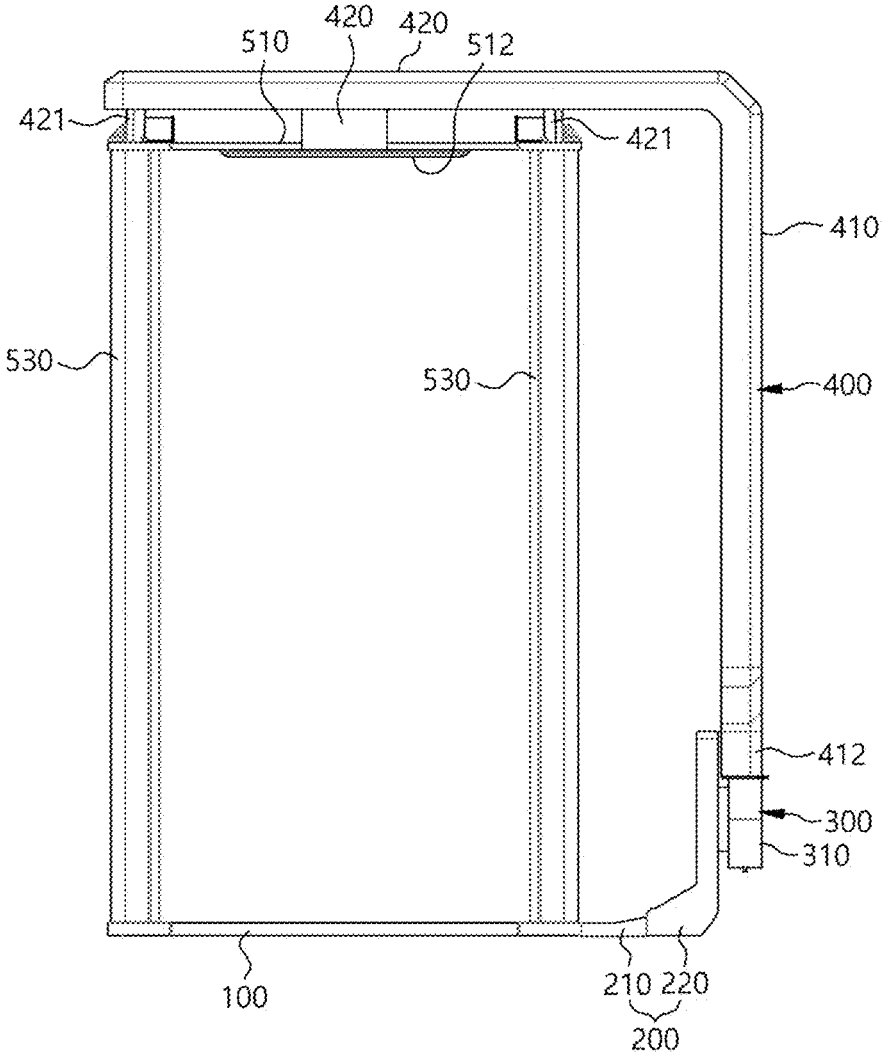
FIG. 3 is a side view illustrating the configuration of the hygiene management device according to an embodiment of the present invention.
Figure 4:
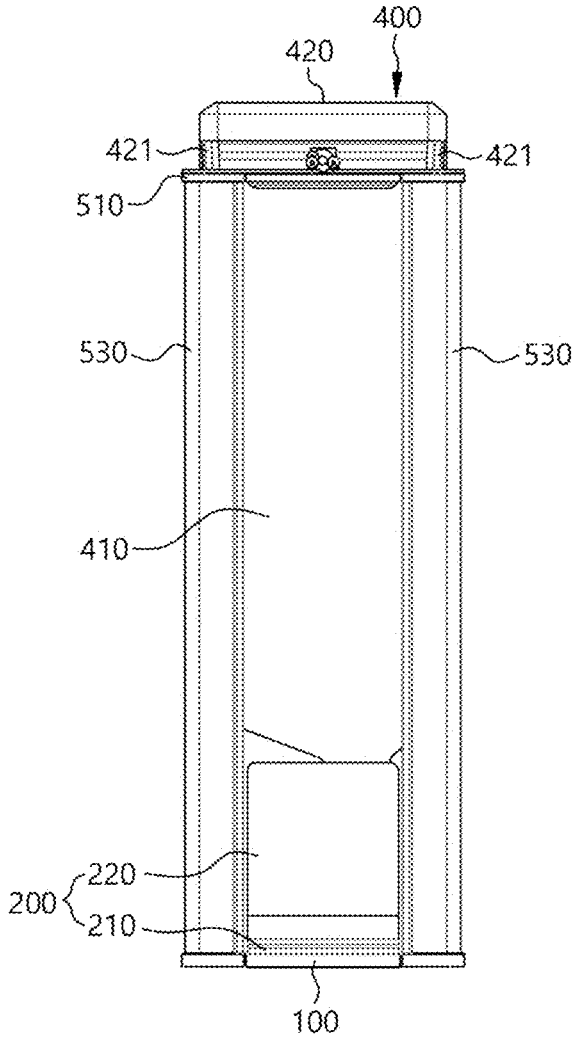
FIG. 4 is a front view illustrating the configuration of the hygiene management device according to an embodiment of the present invention.
Figure 5:
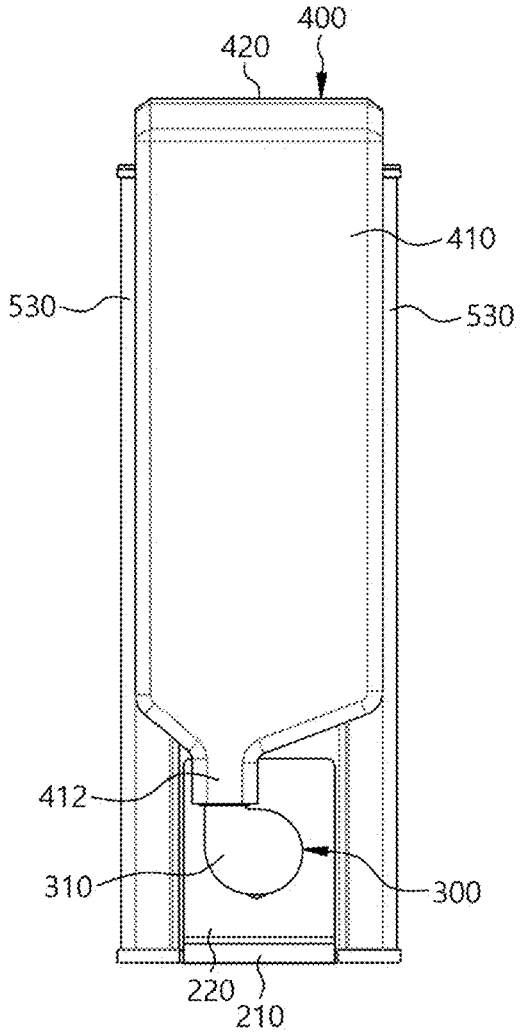
FIG. 5 is a rear view illustrating the configuration of the hygiene management device according to an embodiment of the present invention.
Figure 6:
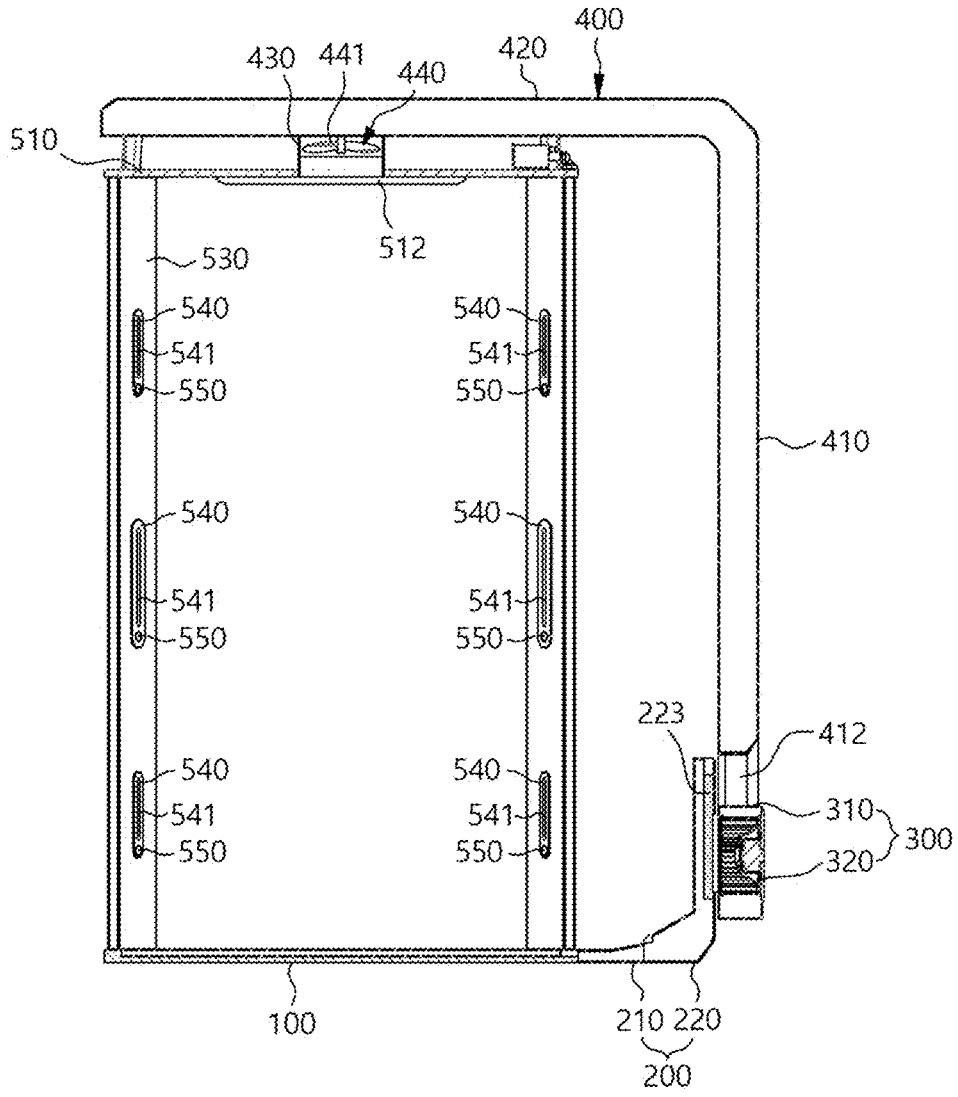
FIG. 6 is a sectional view approximately illustrating the hygiene management device according to an embodiment of the present invention.
Figure 7:
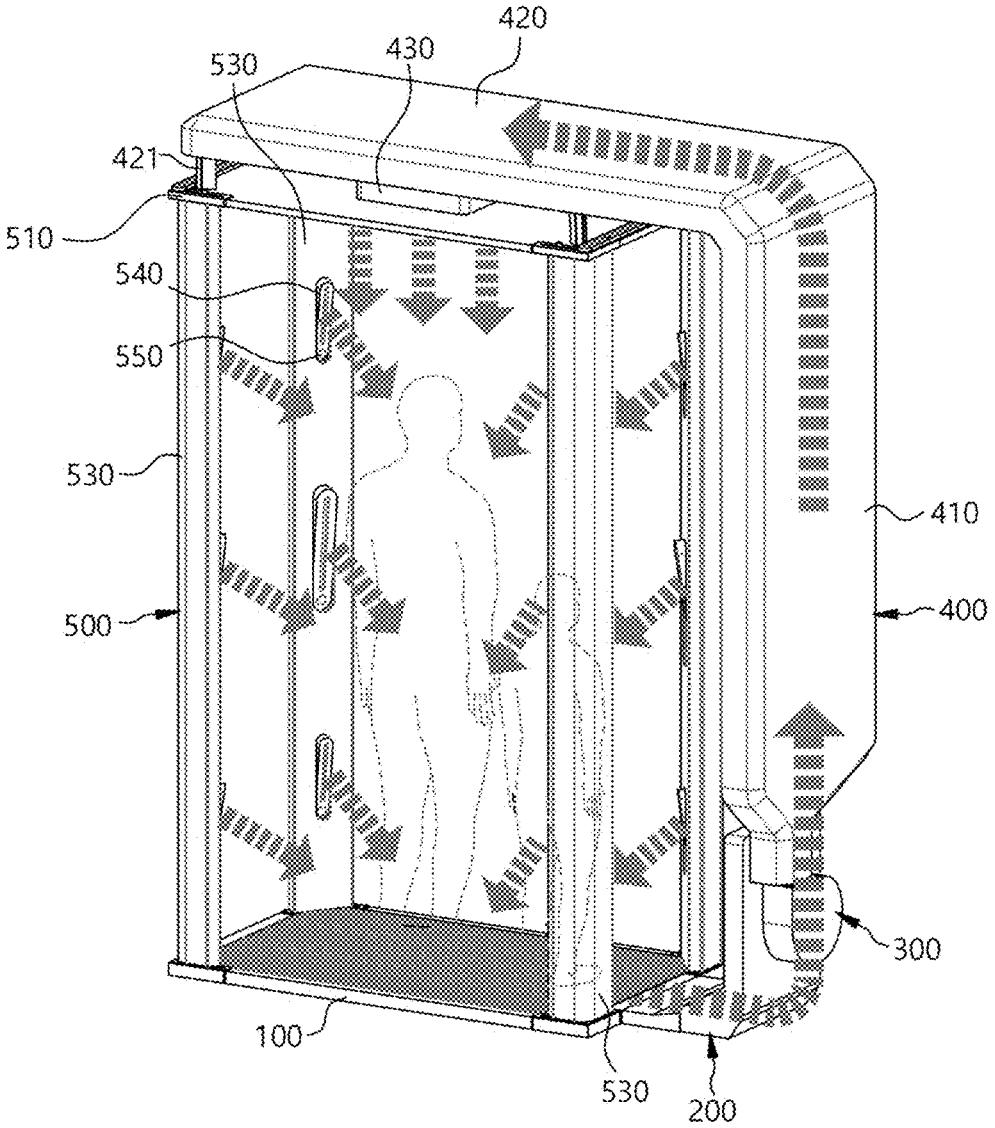
FIGS. 7 and 8 are views illustrating the operation states of a discharge nozzle part of the hygiene management device according to an embodiment of the present invention.
Figure 8:
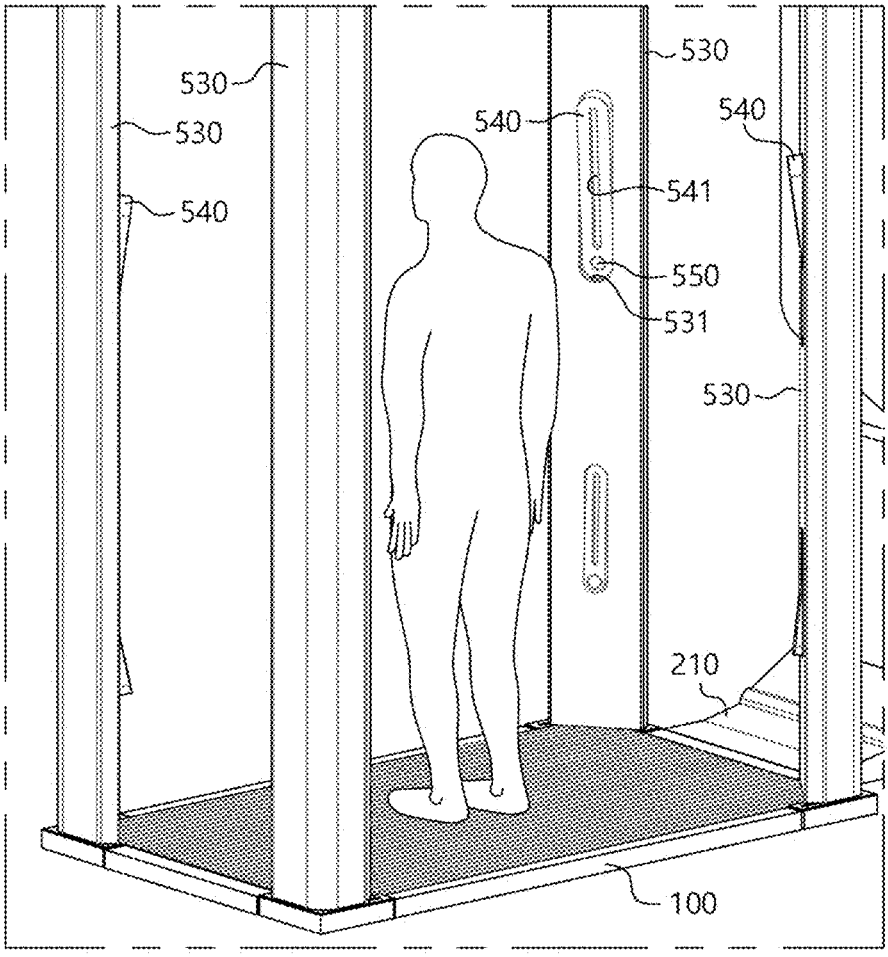
Figure 9:
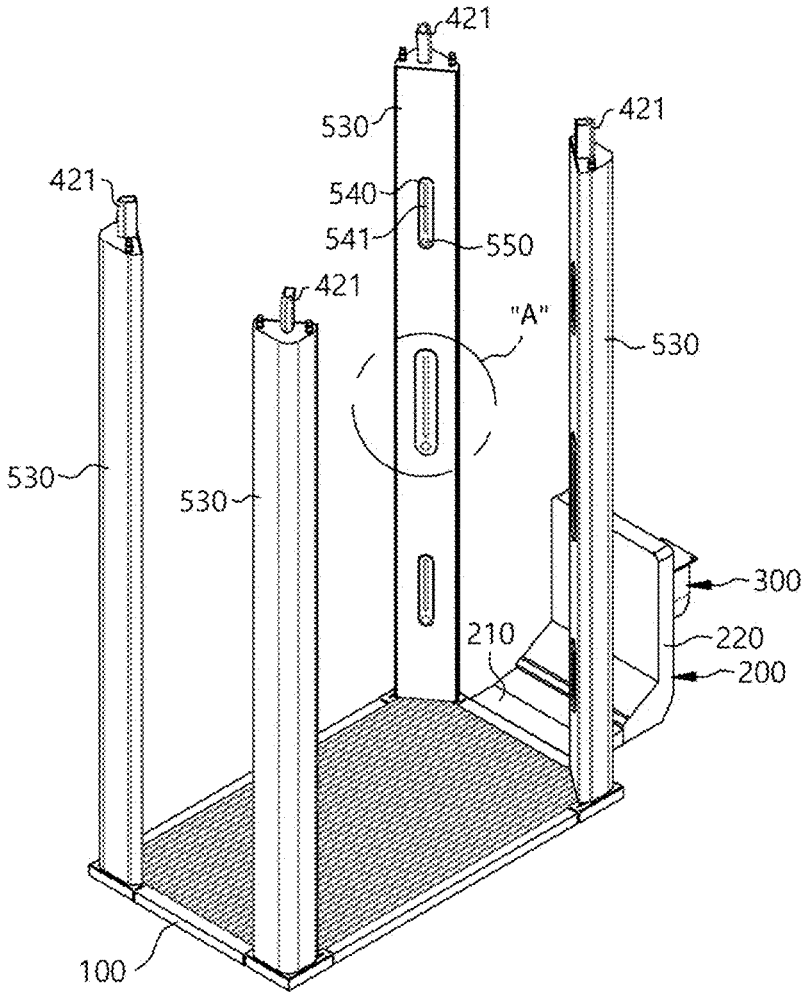
FIG. 9 is a perspective view of a side air discharger in the structure of the hygiene management device for an entrance according to the embodiment of the present invention from which a top air discharger is omitted.
Figure 10:
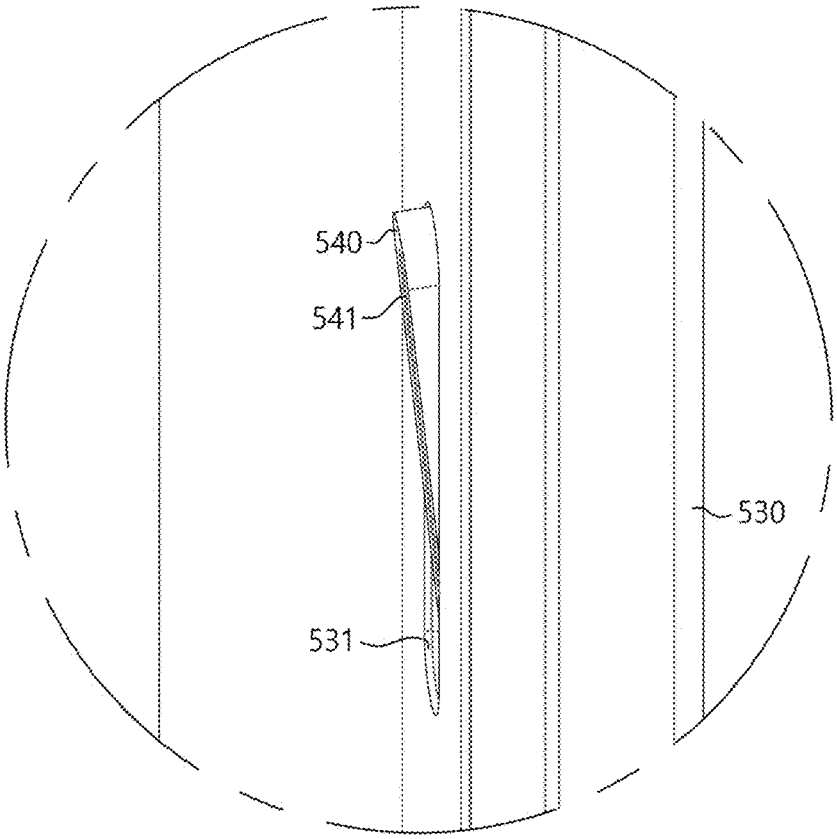
FIG. 10 is an enlarged view of an "A" part of FIG. 9.
Figure 11:
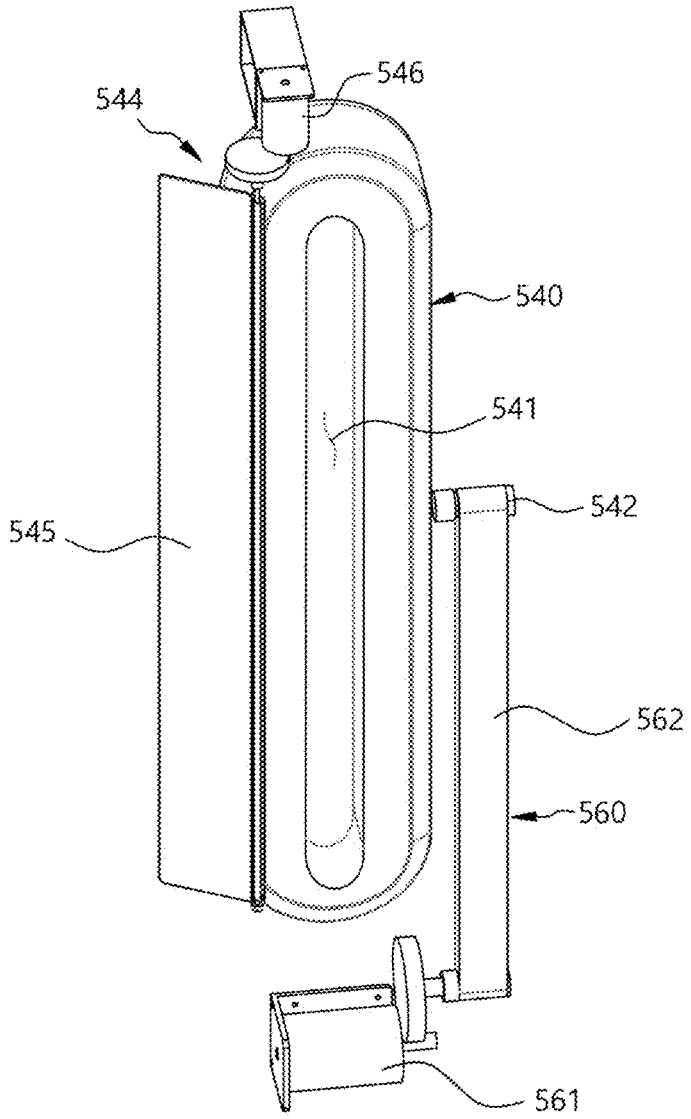
FIG. 11 is a perspective view illustrating the structure of a discharge nozzle tilting part for tilting the discharge nozzle part according to an embodiment of the present invention.
Figure 12:
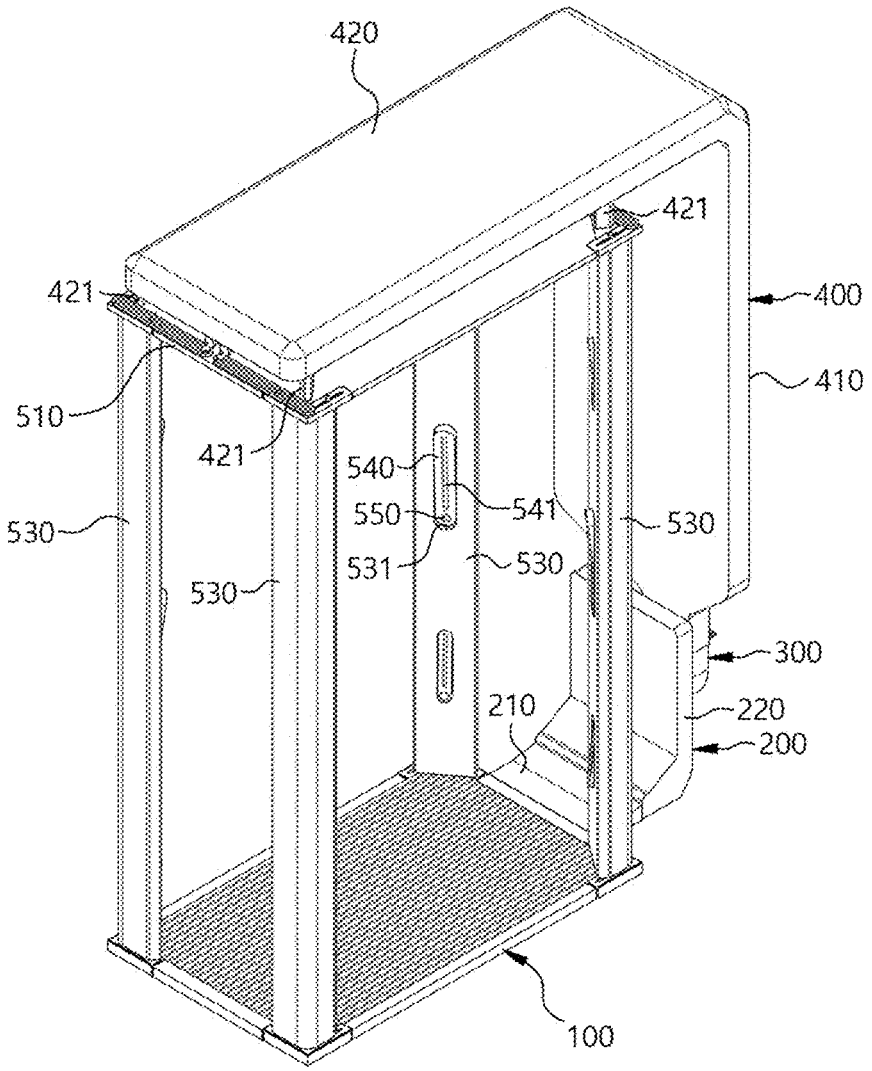
FIG. 12 is a perspective view illustrating the operation state of the discharge nozzle tilting part according to an embodiment of the present invention.
Figure 24:
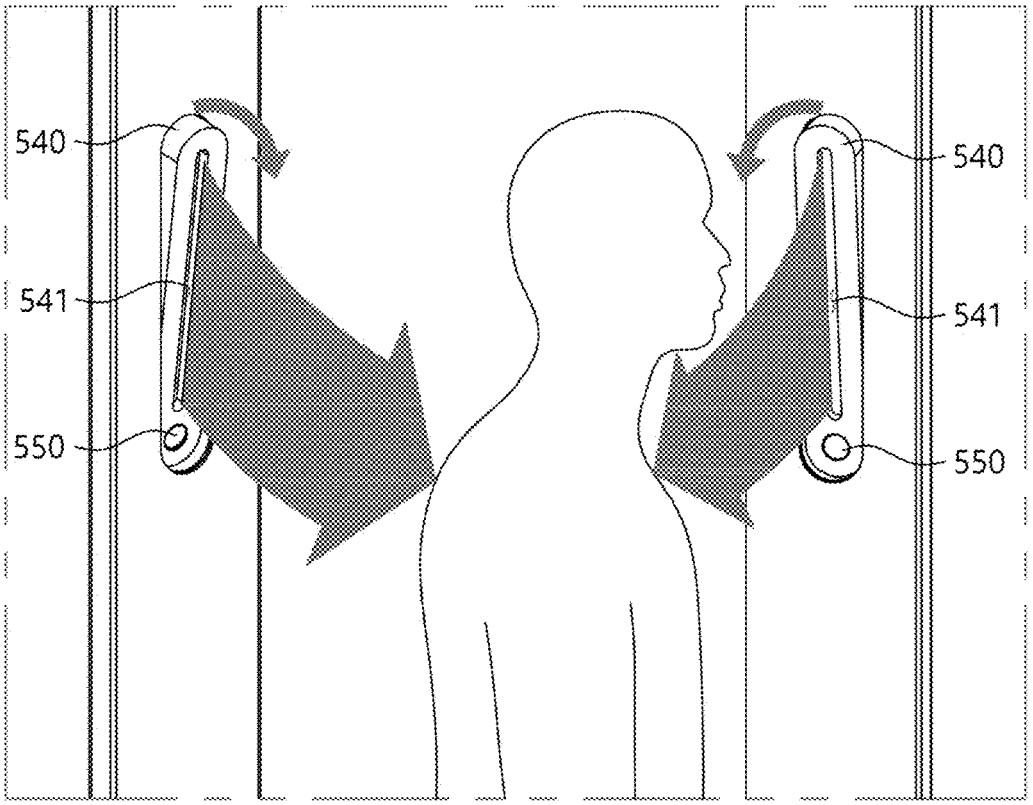
FIG. 24 is a view illustrating the downward tilted state of the discharge nozzle part of the hygiene management device according to an embodiment of the present invention.

The present invention will now be described with reference to the accompanying drawings, wherein the same reference numerals have been used to identify the same or similar elements throughout the several views The exemplary embodiment of a hygiene management device for an entrance hall of the present disclosure will be described in detail with reference to FIGS. 1 and 24.

The hygiene management device according to the embodiment of the present disclosure may be installed in the inner space of the entrance hall for going in and out of a specific indoor space. When the hygiene management device is installed in a residential space, the hygiene management device may be installed in a vestibule. When the hygiene management device is installed in an office space, the hygiene management device may be installed in a separately partitioned space in the entrance hall of the office space.

An entrance door for going out to the outside may be provided on a side surface of the entrance hall, and an inside door for going in and out of the indoor space may be provided on another side surface of the entrance hall.

A footrest 100 may be mounted on the bottom of the entrance hall. The footrest 100 may have a predetermined area such that a person can stand on the footrest, and may function to support the person.

In the illustrated drawings, the footrest 100 may have a cuboid shape and may have an upper surface having a rectangular plate shape. However, according to the shape of an entrance space, the footrest 100 may have various plate shapes.

Multiple air introduction holes may be formed in the upper surface of the footrest 100 so as to introduce the air of the entrance space into the footrest 100. The air of the inside of the entrance space may be introduced into the footrest 100 by the operation of a fan assembly 300, which is described below.

The air introduced into the footrest 100 through the air introduction holes may be transferred through a predetermined flow path to an air management module 200. The air management module 200 may be provided with a filter housing 220.

The footrest 100 and the filter housing 220 may communicate with each other through a fixed connection duct 210. The filter housing 220 may be provided with at least one filter 223. The filters 223 may function to remove foreign matter contained in air guided to the filter housing 220 through the fixed connection duct 210 and may function to manage the humidity and temperature of the air.

The fan assembly 300 may be mounted to the rear surface of the air management module 200, that is, the outlet of air coming out through the air management module 200. The fan assembly 300 may supply an air blowing force such that air flows in the hygiene management device.

A fan housing 310 may constitute the exterior of the fan assembly 300. A housing inner space may be defined in the fan housing 310, and the housing inner space may be defined such that air introduced from a front of the fan housing is discharged through a side surface of the fan housing to the outside of the fan housing 310 (i.e., to a blowing duct 400).

A blower fan 320 may be installed in the fan housing 310. The blower fan 320 may be driven by a fan motor and may introduce air into the fan housing 310 through the inlet thereof (i.e., inlet of the blower fan 320), and may discharge the air through the outlet of the fan housing 310.

A blowing duct 400 may be connected to the fan assembly 300. The blowing duct 400 may function to move an air flow generated in the fan assembly 300 to the upper side of the entrance hall. The blowing duct 400 may include a first blowing duct 410 and a second blowing duct 420.

The first blowing duct 410 may extend upward along the side wall of the entrance hall. An inlet 412 of the first blowing duct 410 may communicate with an outlet of the fan housing 310 of the fan assembly 300, and thus air may be transferred through the outlet of the fan housing 310 to the inlet 412 of the first blowing duct 410.

The second blowing duct 420 may be located at the upper side of the entrance hall and may define a top surface of the hygiene management device. The second blowing duct 420 may be connected to an outlet of the first blowing duct 410, and thus air passing through the first blowing duct 410 may flow and be guided to an air discharger 530 to be described below.

The air discharger 530 may be configured such that air is discharged into the entrance hall, defined by the hygiene management device. The air discharger 530 may have a predetermined air flow path formed therein and may have a pillar shape.

The air discharger 530 may be installed in the height direction of the entrance space (i.e., a vertical direction). The air discharger 530 may be connected to the footrest 100 (e.g., through the blowing duct 400) and may extend the height direction of the entrance space and may be connected to the second blowing duct 420.

In this case, the air discharger 530 may be connected directly to the second blowing duct 420, or may be connected to the second blowing duct 420 by a guide tube 421 extending from the second blowing duct 420. The guide tube 421 may function to guide air transferred to the second blowing duct 420 to the air discharger 530.

The air discharger 530 may include a plurality of air dischargers. The air discharger 530 may be installed on each of at least two corners of the footrest 100. In the drawing, as the exemplary embodiment, the air discharger 530 is illustrated to be installed on each of four corners of the footrest 100.

Multiple discharge nozzle parts 540 through which air is discharged may be mounted to the air discharger 530. Each of the discharge nozzle parts 540 is a part through which air transferred through an air flow path formed inside the air discharger 530 is discharged to the outside.

An exposure hole 531 may be formed in the discharge nozzle part 540 such that air is discharged through the exposure hole. Such an exposure hole 531 may be directed toward a person to which air is discharged, that is, toward the person located on the footrest 100.

The plurality of discharge nozzle parts 540 may be mounted to the air discharger 530 by being spaced apart from each other in the height direction of the air discharger 530. This is intended for the discharge nozzle parts 540 to discharge air evenly to a person's entire portion.

For example, the discharge nozzle part 540 may include two to four discharge nozzle parts. When two discharge nozzle parts 540 are provided, the two discharge nozzle parts 540 may be installed at heights, respectively, at which air can be discharged to a person's upper and lower body when the person stands on the footrest 100. When three discharge nozzle parts 540 are provided, the three discharge nozzle parts 540 may be installed at heights, respectively, at which air can be discharged to a person's face, waist, and legs. When four discharge nozzle parts 540 are provided, the four discharge nozzle parts may be installed at heights, respectively, at which air can be discharged to a person's face, upper and lower bodies, and feet. Of course, the installation positions and intervals of these discharge nozzle parts 540 may be changed.

The discharge nozzle parts 540 may be configured to have the same size, or to have sizes different from each other. For example, when it is considered that there may be more foreign matter on a person's body than on the person's head, a discharge nozzle part 540 located at the center portion of the air discharger 530 may be configured to discharge more amount of air than discharge nozzle parts 540 located at other portions of the air discharger 530 and may do so by having a different size than the other discharge nozzle parts 520 (e.g., a bigger size).

Each of the discharge nozzle parts 540 may be configured to be tilted at a predetermined angle relative to the height direction of the air discharger 530. This is intended to adjust the discharge direction of air according to a person's height or face position. Accordingly, air may be discharged to a necessary position, but may not be discharged in an undesired direction. For example, like that illustrated in FIG. 24, air may be discharged to a person with the discharge nozzle part 540 tilted downward such that air is not discharged directly to the person's face.

In order to tilt the discharge nozzle parts 540 relative to the height direction of the air discharger, each of the discharge nozzle parts 540 may be provided with a rotation shaft 542 mounted thereto such that the discharge nozzle part 540 can be tilted relative to the height direction of the air discharger 530, and a discharge nozzle tilting part 560 configured to tilt the discharge nozzle part 540 relative to the height direction of the air discharger relative to the rotation shaft 542.

The discharge nozzle tilting part 560 may be driven (i.e., controlled) by a controller 900 (i.e., a hardware embedded processor), which is described below. When the discharge nozzle tilting part 560 is driven by the controller 900, the rotation shaft 542 may rotate to tilt the discharge nozzle part 540 connected to the rotation shaft 542.

The discharge nozzle tilting part 560 may include a rotary motor 561. The rotational force of the rotary motor 561 may be transmitted through a power transmission member 562 to the rotation shaft 542. The controller 900 may control the rotary motor 561 to move the power transmission member 562, which in turn rotates the rotation shaft 542 to move the discharge nozzle part 540 (e.g., to tilt).

When the rotary motor 561 rotates clockwise, the rotation shaft 542 may be rotated in one direction (e.g., a first direction) by the power transmission member 562 such that the discharge nozzle part 540 can be tilted in an upward direction.

Contrarily, when the rotary motor 561 rotates counterclockwise, the rotation shaft 542 may be rotated in a direction contrary to the one direction (e.g., a second direction) such that the discharge nozzle part 540 can be tilted in a downward direction (e.g., toward the footrest 100).

The tilting angle of the discharge nozzle part 540 may be determined according to the degree of clockwise and counterclockwise rotation of the rotary motor 561.

In another embodiment, the discharge nozzle tilting part 560 may be configured as a device using an actuator or hydraulic pressure.

A damper assembly 544, which controls air discharge may be mounted to the discharge nozzle part 540. The damper assembly 544 may control the flow of discharge air through the discharge nozzle part 540 by opening or closing the flow path of air through a discharge hole 541 of the discharge nozzle part 540.

The damper assembly 544 may be driven by the controller 900, which is described below.

When the damper assembly 544 is driven and an air flow path is closed, air may not be discharged from the discharge nozzle part 540. When the damper assembly 544 is driven again and the air flow path is opened, air may be discharged from the discharge nozzle part 540.

The amount of air discharged through the discharge hole 541 of the discharge nozzle part 540 may be adjusted according to a degree to which the damper assembly 544 is driven.

The damper assembly 544 may include a damper 545 installed in the flow path of air discharged to the outside and configured to open and close the flow path, and a damper drive motor 546 configured to drive the damper 545. The damper 545 may be configured to open and close the flow path through the discharge nozzle part 540 by a user's manipulation. Alternatively, in another embodiment, as an alternative to the damper 545, a flow path open/close valve may be used to open and close the associated flow path, as known in the art.

A top plate 510 may be configured to be integrated with the second blowing duct 420. Alternatively, the top plate 100 may be provided separately from the second blowing duct 420, and may be configured to be fixed to the second blowing duct 420.

In an embodiment, the top plate 510 may be configured to be located under the second blowing duct 420 to support the second blowing duct 420. That is, the second blowing duct 420 may be configured to be supported by the top plate 510. Additionally, the top plate 510 may be connected and fixed to the air discharger 530.

The top plate 510 may be formed to have a flat plate structure and may be formed in a rectangular, circular, or polygonal shape when viewed from the lower side of the top plate 510, or alternatively may have any shape.

Figure 13:
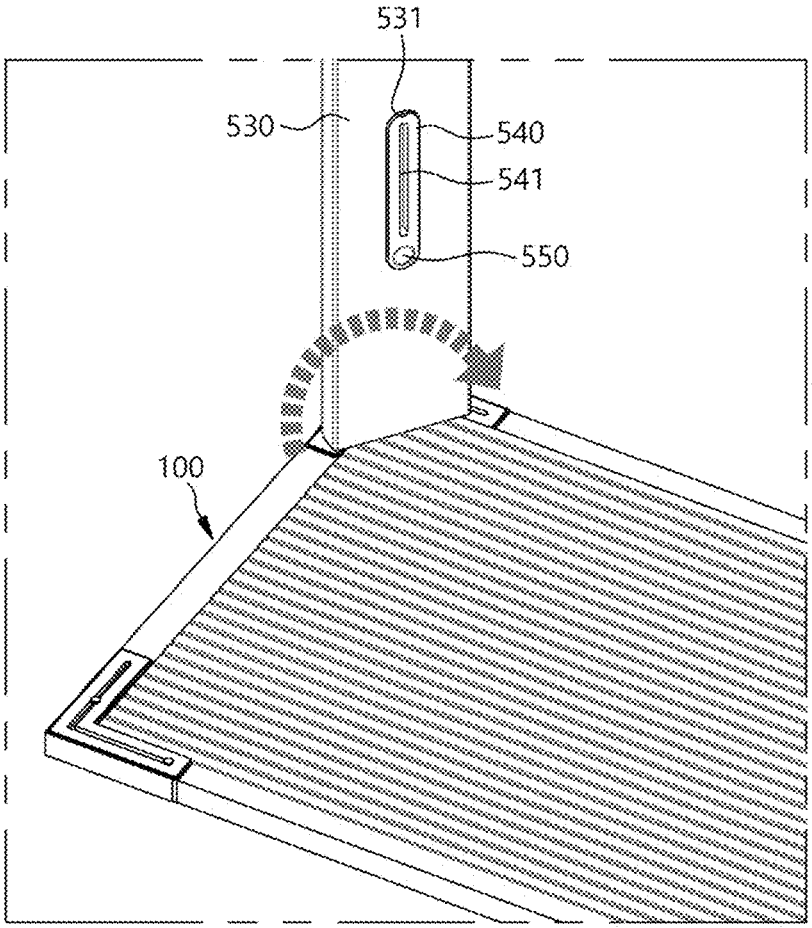
FIGS. 13 and 14 are perspective views illustrating the rotation states of the side air discharger of the hygiene management device according to an embodiment of the present invention.
Figure 14:
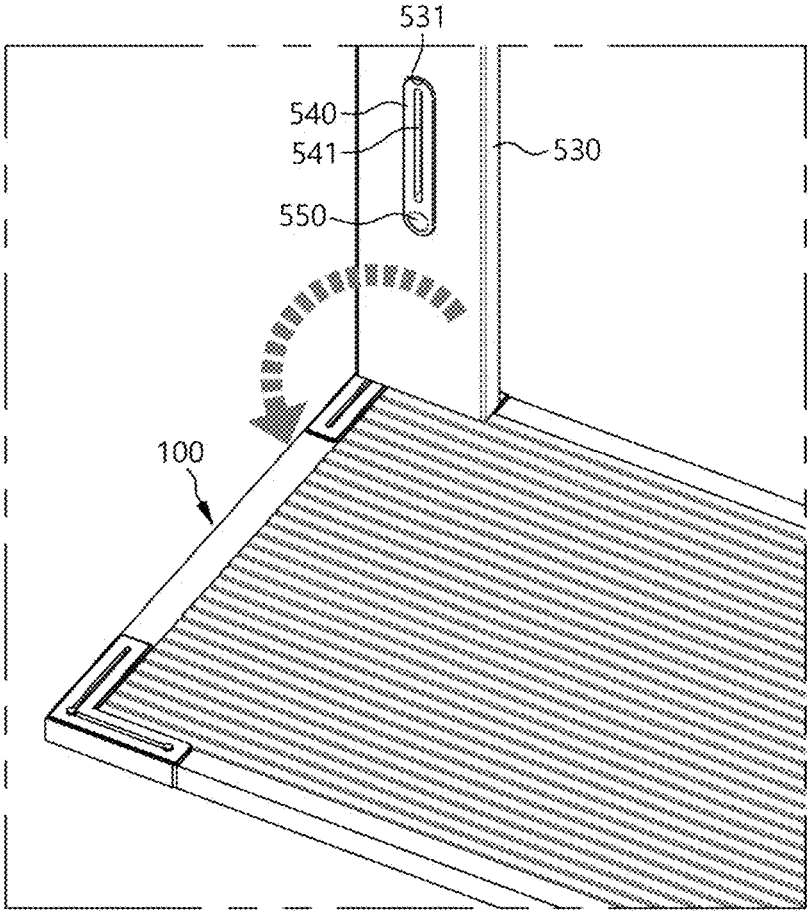

The air discharger 530 may be configured to rotate toward opposite sides relative to the footrest 100 or the top plate 510. That is, the air discharger 530 may be configured such that the lower surface of the air discharger 530 rotates toward opposite sides relative to the footrest 100 (i.e., rotates towards or away from opposing sides of the footrest 100) or the upper surface of the air discharger 530 rotates toward the opposite sides relative to the top plate 510 i.e., rotates towards or away from opposing sides of the top plate 510). In FIGS. 13 and 14, states in which the air discharger 530 rotates toward the opposite sides relative to the footrest 100 are illustrated.

Accordingly, when a person is passing through the hygiene management device according to the present invention, the air discharger 530 may continuously discharge air to the person and may effectively remove contaminants attached to the person.

Figure 23:
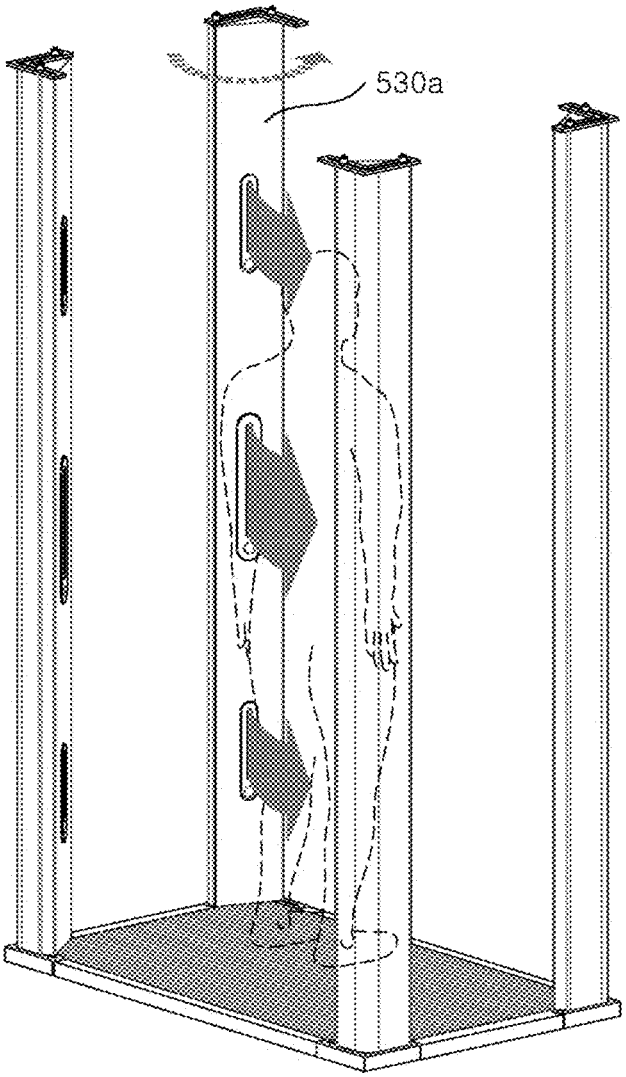

In addition, FIG. 23 illustrates a state in which when a person moves to a corner of the footrest 100 (i.e., a first corner), an air discharger 530*a* located close within a preset distance from the person (i.e., closest to the first corner of the footrest 100) rotates in a direction toward the person to continuously discharge air.

That is, even if a person moves on the footrest 100 or passes the footrest 100, air may be continuously discharged to a person. The change of a person's position according to the person's movement may be detected by a detector 550 to be described below.

All or at least some of the plurality of air dischargers 530 may be configured to rotate toward opposite sides. Accordingly, even if a person stands on any one side of the footrest 100, all or some of the air dischargers 530 may discharge air toward the person. That is, all of the air chargers 530 are configured to rotate to direct air towards any portion of a person standing at any position on the footrest 100.

Meanwhile, the hygiene management device may include the detector 550. The detector 550 may include a first detector 551 configured to detect the presence and position of a person (e.g., a motion sensor, a position sensor or the like), and a second detector 552 configured to recognize a person's face.

The first detector 551 may detect distance between the air discharger 530 and a person located at a preset position in the entrance hall. That is, when a person stands on the footrest 100, the first detector 551 may measure the distance between the air discharger 530 and the person. The first and second detectors 551 and 552 may be physical devices that detect or measure a physical property and may send this information to the controller 900.

The first detector 551 may be mounted to each of the plurality of air dischargers 530. The first detector 551 may measure distance between the air discharger 530 and a person.

The first detector 551 may be embodied as a distance measuring sensor capable of measuring distance between the air discharger 530 and an object, for example, as a laser distance measuring sensor, an ultrasonic distance measuring sensor, an infrared distance measuring sensor, and an optical distance measuring sensor, etc.

The second detector 552 may recognize and identify a person's face. The second detector 552 may include a face recognition camera. The face recognition camera may be equipped with a face recognition program or software to recognize and identify a person's face located at a preset position. The face recognition camera may photograph a person's entire body part and recognize the person's face among the photographed body part.

The second detector 552 may be mounted to the air discharger 530. It is preferable that the second detector 552 is installed at about the height of a person's face in consideration of the person's height. In the air discharger 530, the second detector 552 may be provided in plurality and spaced in the height direction of the air discharger 530.

Alternatively, one face recognition camera 552 which uses a wide-angle lens or a lens having a large angle of view capable of detecting a person's entire body part may recognize the person's face.

In addition, the second detector 552 may detect the position of the recognized face. Through the position of the detected face, the second detector 552 may recognize where a person is located relative to the air discharger 530 and relative to the footrest 100. On the basis of this, the air discharger 530 may rotate to discharge air toward the person.

The result detected by the detector 550 may be transmitted to the controller 900 to be described below.

In addition, a control panel 352 may be mounted to one surface of the air discharger 530. The control panel 352 may preset and control the overall operation of the hygiene management device by being touched or input by a person.

The control panel 352 may be a device in which an input device and a display device (a display, i.e., a physical display, such as an OLED display, a touchscreen and the like) are integrally embodied. The input device may be a touch input part 353 embodied as a touch pad or a touch screen.

A person may use the control panel 352 to preset the position and direction of air discharge such that the air discharge suitable for the person is performed.

To this end, through the control panel 352, a person may, in advance, register and store the person's face detected by the detector 550 in a storage part 901 to be described below. The storage part 901 may include nonvolatile memory such as a hard disk drive, a flash memory, an electrically erasable programmable read-only memory (EEPROM), any type of volatile or nonvolatile memory, such as a static random access memory (SRAM), a ferroelectric random access memory (FRAM), and a phase change random access memory (PRAM), but is not limited thereto.

In addition, by corresponding to the person's face preregistered through the control panel 352, the person may preset a discharge nozzle part 540 through which air will be discharged among multiple discharge nozzle parts 540, and may adjust the tilting angle of the discharge nozzle part 540 relative to the height direction (a vertical direction) of the air discharger 530.

The control panel 352 may transmit the preset information input through the touch input part 353 by a person to the controller 900, and the controller 900 may store this preset information in the storage part 901.

The control panel 352 may include a voice recognition part 354 and a voice output part 355. The voice recognition part 354 may process information input or preset through voice by a person. The voice recognition part 354 may include a microphone and software to detect a user's voice.

The voice output part 355 may output guide information related to the control and operation of the hygiene management device.

The detector 550 may be used to recognize a person's face according to the guide information output by the voice output part 355.

Alight emitting part may be mounted to the second detector 552 of the detectors 550. The light emitting part may be any type of light, such as a light-emitting diode (LED) or other known lighting device.

When a face recognition request is input to the control panel 352 by a person, the light emitting part may emit light, and the person may approach the light emitting part such that the second detector 552 properly recognizes the person's face. The light emitting part is intended such that a person's face is located at a position in a direction in which the second detector 552 properly recognizes the person's face.

Accordingly, in the hygiene management device, when each person stands on the footrest 100 after the person's face is recognized and the position and direction of air discharge suitable for the person are preregistered (i.e., stored in the storage part 901), the second detector 552 may recognize the person's face and air may be discharged to the preregistered air discharge position and direction. Accordingly, customized air discharge for each person may be performed.

For example, air discharge may be preset not to be discharged directly to the face of a person who has a poor respiratory organ. Air discharge may be preset not to be discharged directly to the head of a person who wears a wig.

The positions of air discharge may be determined by all or some discharge nozzle parts 540, through which air is discharged, selected among a plurality of discharge nozzle parts 540. In addition, the direction of air discharge may be determined by the discharge nozzle part 540 tilted relative to the height direction of the air discharger.

Figure 15:
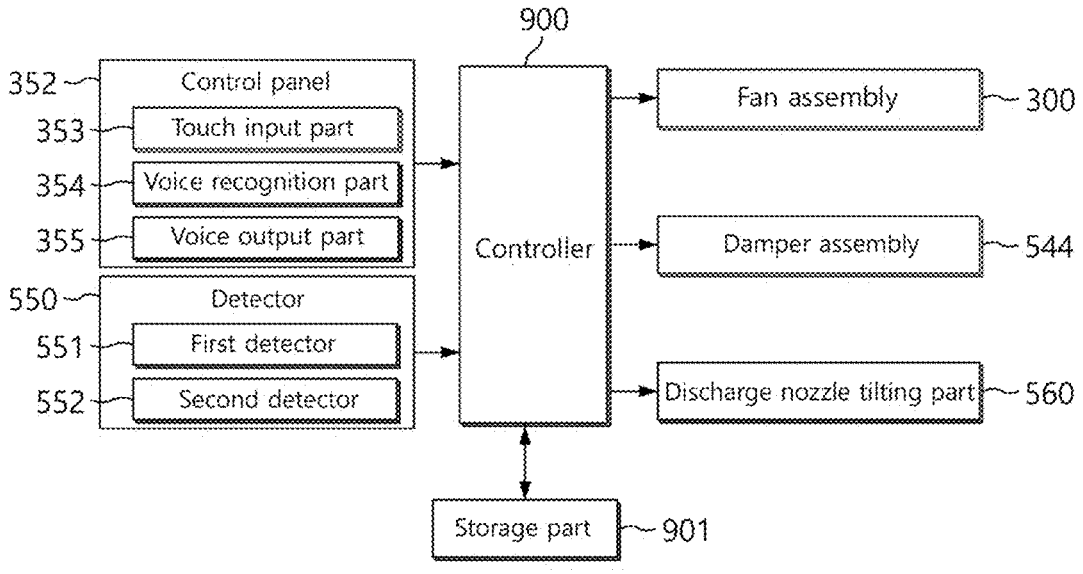
FIG. 15 is a block diagram illustrating components connected with a controller in the hygiene management device according to an embodiment of the present invention.

FIG. 15 is a block diagram illustrating components connected with the controller 900 which controls the hygiene management device, and FIGS. 16 to 20 are flowcharts illustrating the operation of the hygiene management device according to the embodiments of the present disclosure.

Figure 16:
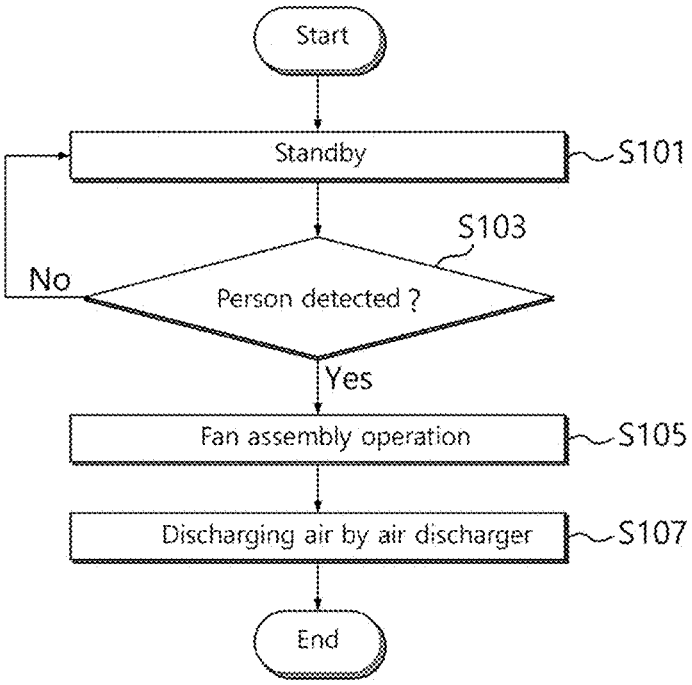
FIGS. 16 to 20 are flowcharts illustrating the operation of the hygiene management device according to embodiments of the present invention.

When a person stands on the footrest 100, the operation of the hygiene management device will be described with reference to FIGS. 15 and 16.

In a state in which the hygiene management device of the present disclosure is installed in the inner space of the entrance hall, the hygiene management device may initially maintain a standby state at S101. In the standby state, air is not discharged.

When a person goes into the entrance hall and stands on the footrest 100, the detector 550 may detect a person at S103. The result detected by the detector 550 may be transmitted to the controller 900.

Accordingly, the controller 900 may operate the fan assembly 300 according to the detector 550 detecting a person at S105.

Air may be flown by an air blowing force generated by the operation of the fan assembly 300 and may be transferred through the blowing duct 400 to the air discharger 530 such that air can be discharged through the discharge nozzle part 540 at S107. In this case, the air may be discharged toward a person.

Such air discharge may be performed for a preset time. Even before the preset time elapses, the air discharge may stop when the detector 550 does not detect the person.

An air discharge process will be described in detail. When the fan assembly 300 operates due to a detected person, an air blowing force may be generated by the rotation of the blower fan 320. Air introduced into the footrest 100 through the air introduction holes thereof may be transferred to the air management module 200 by such an air blowing force.

The air transferred to the air management module 200 may pass through the filters 223, such that contaminants contained in the air are removed. The air coming out from the air management module 200 may be transferred through the fan housing 310 sequentially to the first blowing duct 410 and the second blowing duct 420 by the air blowing force.

The air transferred from the second blowing duct 420 may be transferred through the guide tube 421 (e.g., multiple guide tubes 421) into each of multiple air dischargers 530. That is, each guide tube 421 may correspond to a respective one of the multiple air dischargers 530 to transfer air from the second blowing duct 420 to the respective air discharger 530. The air transferred to each of the air dischargers 530 may be supplied through an air flow path formed therein to the multiple discharge nozzle parts 540.

The air supplied to each of the discharge nozzle parts 540 may be discharged to the outside through the discharge hole 541 formed in the discharge nozzle part 540. That is, the air may be discharged toward a person.

In addition, the air discharged as described above may be introduced into the entrance space, and may be introduced back into the footrest 100 through the air introduction holes of the footrest 100, and then may flow sequentially to the air management module 200, the fan assembly 300, and the blowing duct 400. Accordingly, an air circulation process may be repeatedly performed.

In the air circulation process, fine dust, moisture, and contaminants attached to a person may be removed. Additionally, contaminants and fine dust attached to an object held by a person may be removed.

Figure 17:
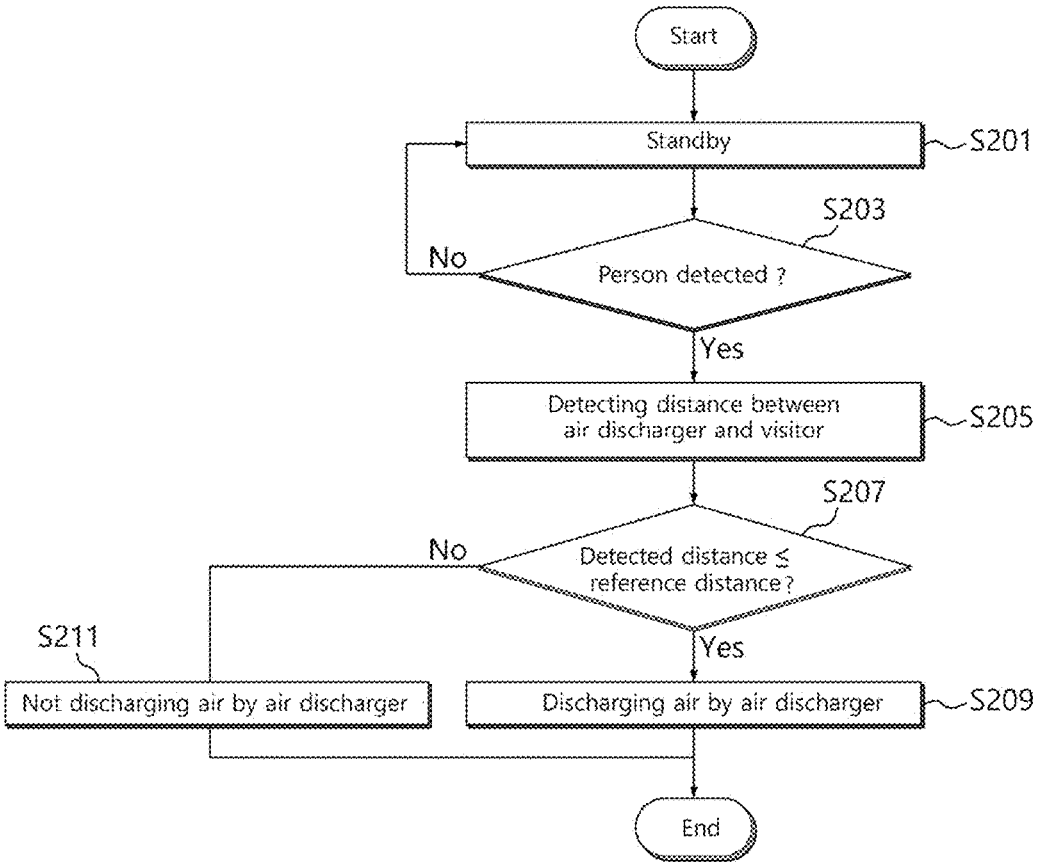

The operation of the hygiene management device according to a person's position detected by the detector 550 will be described with reference to FIG. 17.

The hygiene management device may maintain a standby state at S201, and when a person stands on the footrest 100, the detector 550 may detect the person on the footrest 100 at S203.

When the person is detected, the detector 550 may detect a distance between the air discharger 530 and the person (e.g., visitor) at S205. That is, the first detector 551 may detect the distance between the air discharger and the person.

Since the detector 550 is mounted to the air discharger 530, a distance between the first detector 551 and the person may be the distance between the air discharger 530 and the person.

When the detected distance is a preset reference distance or less, that is, when the detected distance between the air discharger 530 and the person is the same as or less than the reference distance at S207, the air discharger 530 may discharge air at S209. However, when the distance between the air discharger 530 and the person is longer than the reference distance, the air discharger 530 may not discharge air at S211.

Such an air discharge process may be applied equally to all the air dischargers 530.

Such a reference distance may be information used to determine whether to discharge air by the air discharger 530. That is, an air discharger 530 close to a person may discharge air, but an air discharger 530 far from the person may not discharge air.

Figure 21:
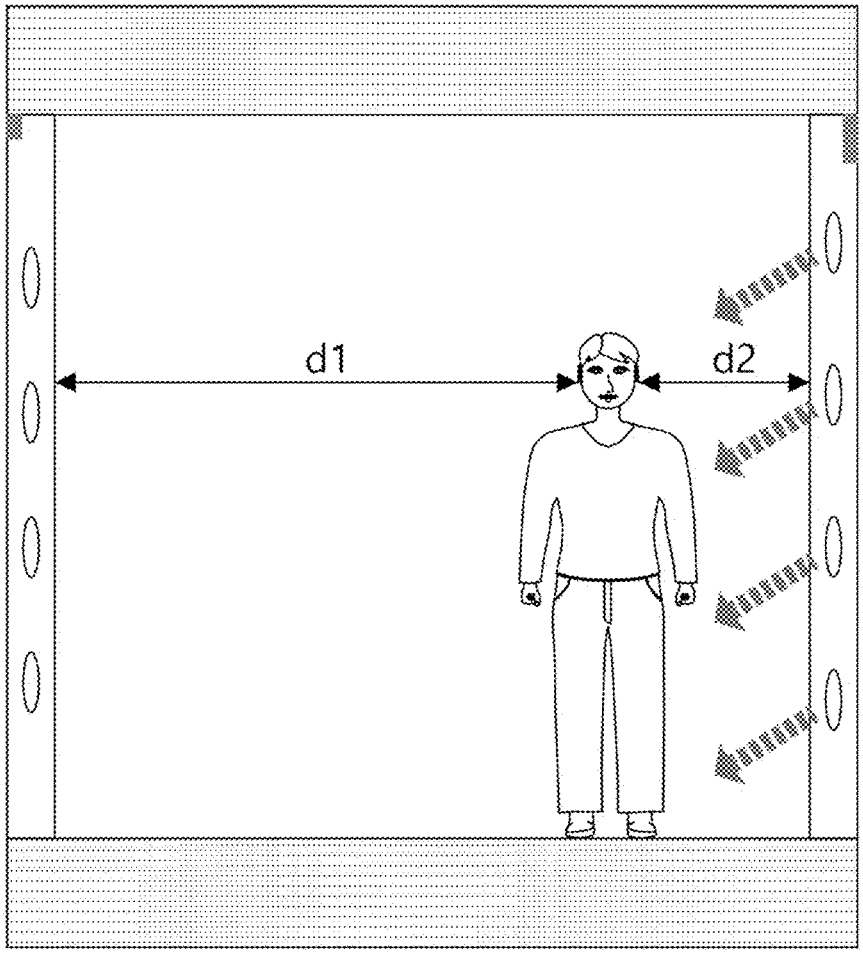
FIG. 21 is a front view illustrating a state in which when a person stands at a right side, one of the air dischargers discharges air.

FIG. 21 is a view illustrating a state in which when a person stands at a right side of the footrest 100, only a right air discharger 530 close (i.e., closest) to the person discharges air. That is, distance d1 between a left air discharger 530 and the person is longer than the reference distance, and distance d2 between the right air discharger 530 and the person is shorter than the reference distance.

In order for the air discharger 530 to discharge air, the controller 900 may operate the damper assembly 544 mounted to the discharge nozzle part 540 to open the damper 545. In order for the air discharger 530 not to discharge air, the controller 900 may operate the damper assembly 544 to close the damper 545. That is, the controller may operate the damper assembly 544 via the damper drive motor 546 and/or the rotary motor 561.

The operation of the air discharger 530 by the controller 900 for air discharge may mean the operation of the damper assembly 544, and this may mean that the damper drive motor 546 is driven to operate the damper 545.

Figure 22:
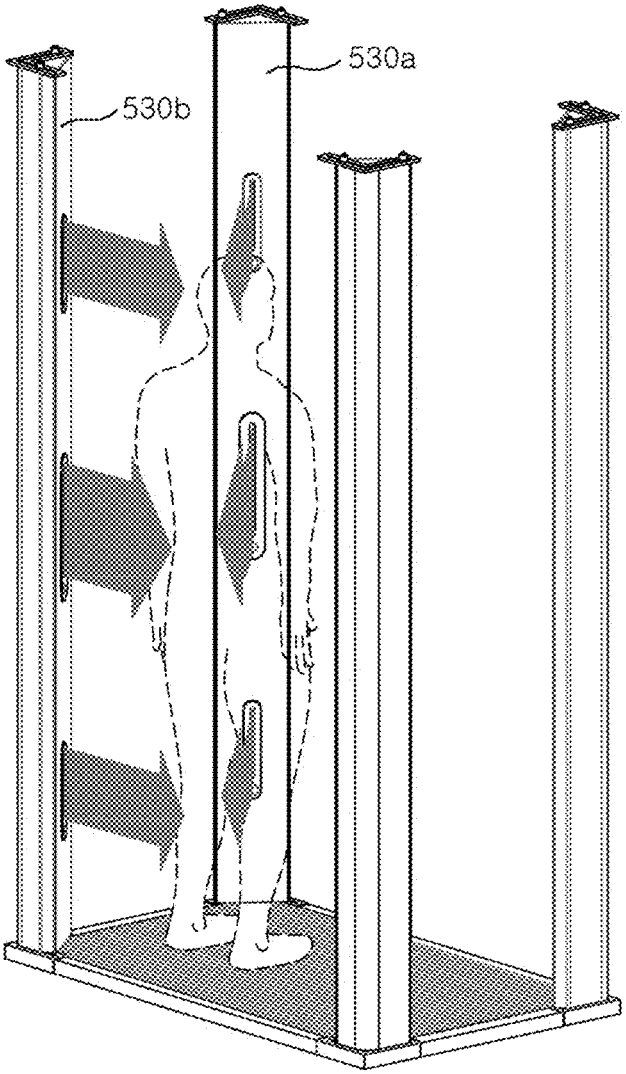
FIGS. 22 and 23 are views illustrating states, viewed from an upper side, in which some air dischargers discharge air in the hygiene management device according to an embodiment of the present invention when each person is located at a specific position.

Even in FIG. 22, in the same way, a state in which only some air dischargers 530*a* and 530*b* close to a person within the reference distance discharge air is illustrated.

Figure 18:
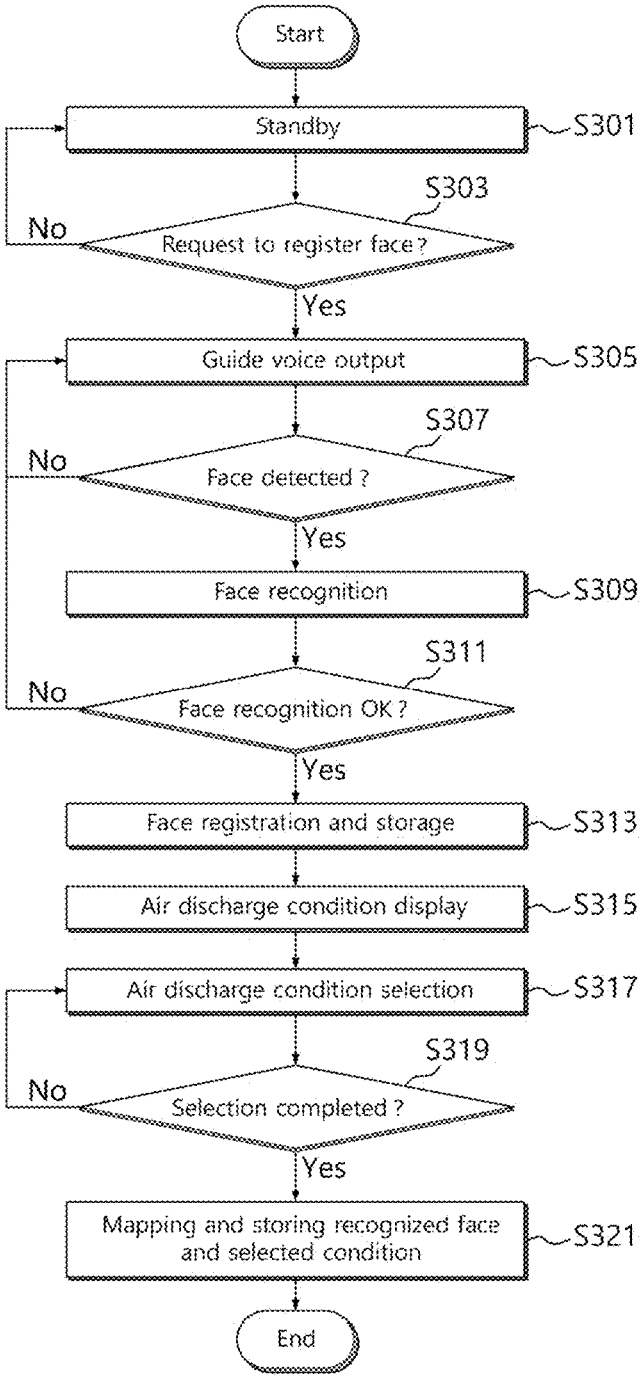

The operation of the hygiene management device according to the registration of a person's face and air discharge condition for a customized air discharge for the person will be described with reference to FIG. 18.

In the standby state of the hygiene management device at S301, when a face registration request is input through the control panel 352 at S303, a guide voice for face registration may be output at S305. The guide voice may be output through a speaker of the hygiene management device.

The guide voice is intended to explain the procedure or process of the face registration to a person, and may be output through the voice output part 355.

When the second detector 552 detects a person's face due to the person's movement for the face recognition according to the guide voice at S307, the second detector 552 may recognize the person's face at S309.

The second detector 552 may determine whether the person's face is properly recognized at S311, and when the person's face is not properly recognized, a guide voice to retry may be output (e.g., the process is returned to S305), but when the person's face is properly recognized, the recognized face may be stored in the storage part 901 to complete registration at S313.

When the face registration is completed, the process of presetting an air discharge condition in correspondence to the registered face may be performed. To this end, when the face registration is completed, first, the air discharge condition may be displayed on the display device (a display) of the control panel 352 at S315.

The person may select the air discharge condition displayed on the display device at S317. When the selection is completed at S319, the recognized face and the selected air discharge condition may be mapped to each other and stored in the storage part 901 at S321.

Various air discharge conditions may be selected.

For example, one of multiple air dischargers 530 to discharge air may be selected by the person/user. In addition, which one of multiple discharge nozzle parts 540 to discharge air may be selected. Additionally, direction and angle at which the discharge nozzle part 540 is tilted may be selected. Furthermore, the speed, amount, and pressure of air to be discharged may be selected.

Accordingly, a person may preset and preregister an air discharge condition suitable for the person along with the registration of the person's face.

Figure 19:
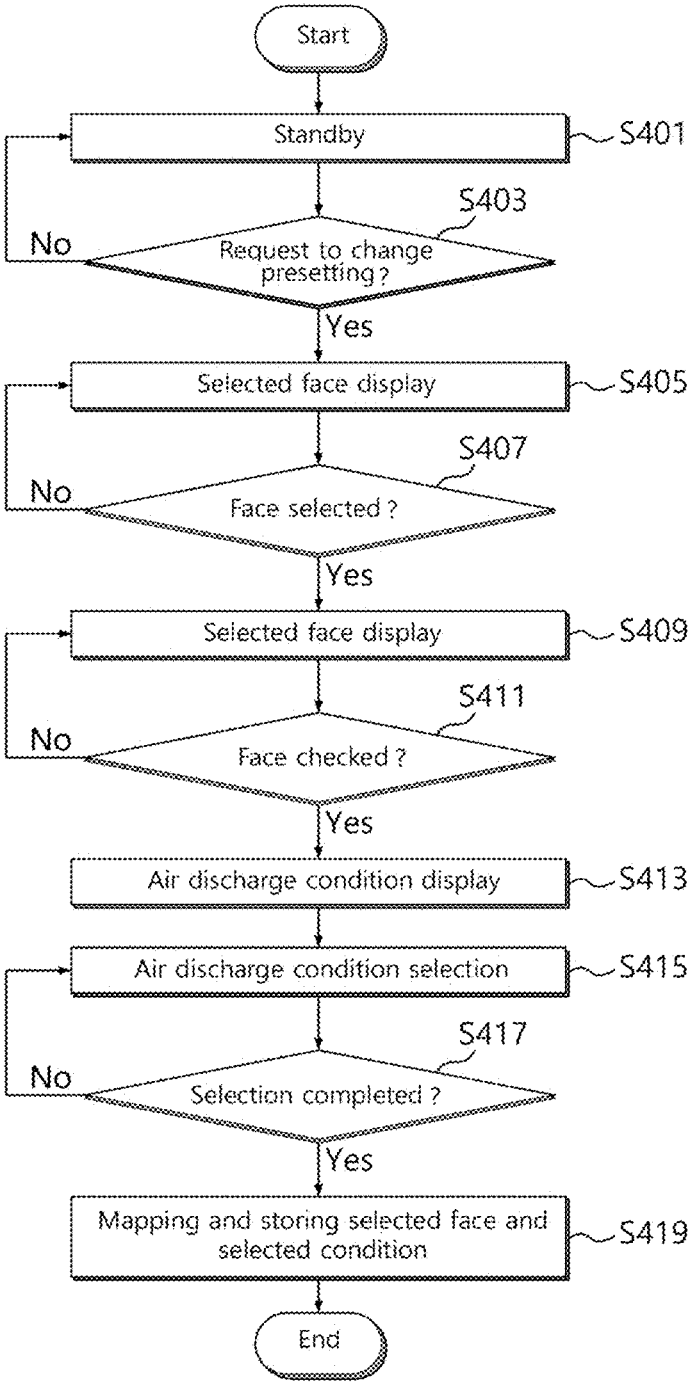

The operation of the hygiene management device according to the air discharge condition changed by a person will be described with reference to FIG. 19.

In a standby state of the hygiene management device at S401, when a request for changing the presetting of an air discharge condition is input from a person through the control panel 352 at S403, the preregistered face of the person may be displayed on a display part S405. In this case, when there is no preregistered face, a guide voice to first perform the face recognition and registration may be output.

The person may select his/her face among faces displayed in the display part. When the person's face is selected at S407, only the selected face may be displayed at S409.

When the person checks that the selected face is the person's face at S411, the air discharge condition may be displayed at S413. In this case, selected and unselected air discharge conditions pre-mapped for the selected face may, for example, be displayed separately in different colors or shades. This is to easily distinguish the selected condition from the unselected condition.

Among the displayed air discharge conditions, the air discharge condition which the person wants to change may be selected at S415, and when the selection is completed at S417, the previously selected face and the selected air discharge condition may be mapped to each other and stored at S419. Accordingly, the air discharge condition for the person may be changed.

Figure 20:
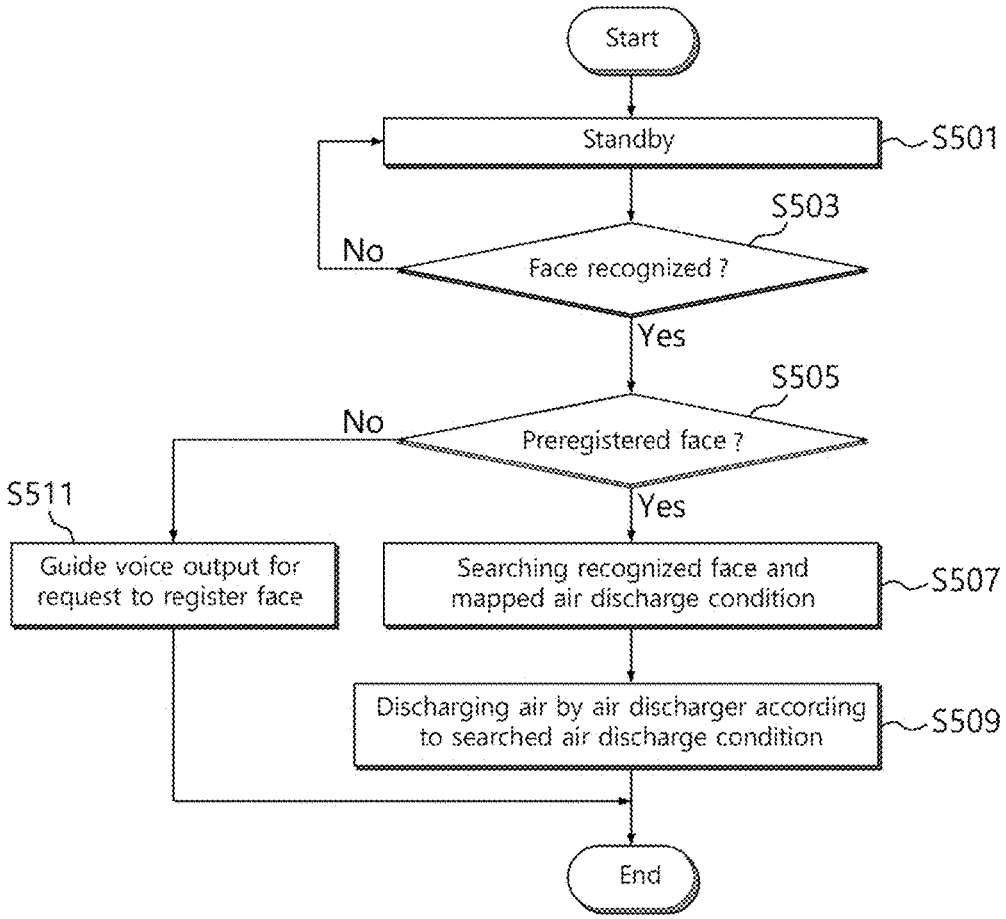

The operation of the hygiene management device according to the recognition of the face of a person going into the entrance space will be described with reference to FIG. 20.

In the standby state of the hygiene management device at S501, when a person stands on the footrest 100, the second detector 552 may try recognizing the person's face.

When the second detector 552 recognizes the person's face at S503, the controller 900 may determine whether the recognized face is a preregistered face at S505.

When the recognized face is the preregistered face, the air discharge condition pre-mapped for the recognized face may be searched in the storage part 901 at S507, and the air discharger may discharge air according to the searched air discharge condition at S509. When the recognized face is not the preregistered face, a guide voice for a request to register a face first may be output at S511.

Accordingly, when the person stands on the footrest 100 after the person registers his or her face in advance and pre-maps and stores an air discharge condition suitable for the person, the person's face may be recognized, and the air discharge condition pre-mapped for the recognized face may be checked such that air is discharged according to the air discharge condition, thereby enabling customized air discharge for the person.

Various embodiments described herein may be implemented in a computer-readable medium using, for example, software, hardware, or some combination thereof. For example, the embodiments described herein may be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, other electronic units designed to perform the functions described herein, or a selective combination thereof. In some cases, such embodiments are implemented by the controller. That is, the controller is a hardware-embedded processor executing the appropriate algorithms (e.g., flowcharts) for performing the described functions and thus has sufficient structure. Also, the embodiments such as procedures and functions may be implemented together with separate software modules each of which performs at least one of functions and operations. The software codes can be implemented with a software application written in any suitable programming language. Also, the software codes can be stored in the memory and executed by the controller, thus making the controller a type of special purpose controller specifically configured to carry out the described functions and algorithms. Thus, the components shown in the drawings have sufficient structure to implement the appropriate algorithms for performing the described functions.

In the above, although all components constituting the hygiene management device according to the embodiment of the present disclosure are described as being integrally combined or being operated in combination, the present disclosure is not necessarily limited to this embodiment. That is, within the scope of the present disclosure, at least two of all the components may operate by being selectively combined with each other. In addition, terms such as "include", "comprise", or "have" described above mean that the associated components may be inherent unless otherwise stated, so the terms should be construed not to exclude other components but to further include the other components.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hygiene management device, comprising:

a fan assembly configured to generate an air flow;

a blowing duct configured to receive the air flow from the fan assembly;

at least one air discharger connected to the blowing duct and configured to discharge the air transferred from the blowing duct to a person;

a detector configured to detect a distance between the at least one air discharger and the person and recognize a face of the person; and a controller configured to:

control the at least one air discharger to discharge air in response to the detected distance being a reference distance or less;

control the at least one air discharger to not discharge air in response to the detected distance being greater than the reference distance; and control the at least one air discharger to discharge air according to an air discharge condition that is mapped for the person and stored in a memory in response to the detector recognizing the face of the person, wherein the air discharge condition comprises at least one of information on which air discharger discharges the air, which discharge nozzle part of the at least one air discharger discharges the air, in which direction and at which angle the discharge nozzle part of the at least one air discharger is tilted, a speed, an amount, and a pressure of the air to be discharged.

2. The hygiene management device of claim 1, wherein the at least one discharger includes a plurality of air dischargers spaced apart from each other, and wherein each of the plurality of air dischargers is provided at a respective corner of the hygiene management device.

3. The hygiene management device of claim 2, wherein in response to a distance between at least a first air discharger among the plurality of air dischargers and the detected person being the reference distance or less, the controller is configured to control the at least one first air discharger to discharge air to the person.

4. The hygiene management device of claim 1, wherein each of the at least one air discharger includes a plurality of discharge nozzle parts, and wherein the plurality of discharge nozzle parts are spaced apart from each other in a height direction of the at least one air discharger.

5. The hygiene management device of claim 4, wherein the plurality of discharge nozzle parts are tiltable relative to the height direction of the at least one air discharger to face a preset direction.

6. The hygiene management device of claim 1, wherein the detector includes:

a first detector configured to detect the distance between the at least one air discharger and the person; and a second detector configured to recognize the face of the person.

7. The hygiene management device of claim 1, wherein the at least one air discharger includes a plurality of discharge nozzle parts, and wherein the controller is further configured to control less than all of the plurality of discharge nozzle parts to tilt to preset angles and to discharge air during the air discharge according to the mapped air discharge condition.

8. The hygiene management device of claim 1, wherein the controller is further configured to control the at least one air discharger to stop the air discharge in response to a preset time elapsing after the air discharge.

9. The hygiene management device of claim 1, wherein the controller is further configured to control the at least one air discharger to stop the air discharge in response to the person not being detected by the detector after the air discharge.

10. The hygiene management device of claim 1, further comprising a footrest defining a bottom surface of the hygiene management device and having multiple air introduction holes configured to receive air discharged from the at least one air discharger.

11. The hygiene management device of claim 10, wherein the at least one air discharger includes a plurality of air dischargers, and wherein the plurality of air dischargers are connected between the blowing duct and the footrest and are positioned on corners of the footrest.

12. The hygiene management device of claim 10, wherein the at least one air discharger is rotatable about the blowing duct and the footrest to change a direction of the discharged air, and wherein the at least one air discharger is in a form of a pillar.

13. A control method of a hygiene management device, the control method comprising:

providing the hygiene management device, the hygiene management device including:

a plurality of air dischargers extending vertically and spaced apart from one another; and a detector configured to detect a distance between at least one air discharger and a person and to recognize a face of the person;

detecting, by the detector, a distance between each of the plurality of air dischargers and the person;

discharging air by the at least one air discharger among the plurality of air dischargers to the person in response to the detected distance being a preset reference distance or less and not discharging air in response to the detected distance being greater than the preset reference distance;

recognizing, by the detector, the face of the person; and controlling, by a controller, the at least one air discharger to discharge air according to an air discharge condition that is pre-mapped for the person and stored in a memory in response to the detector recognizing the face of the person, wherein the air discharge condition comprises at least one of information on which air discharger discharges the air, which discharge nozzle part of the at least one air discharger discharges the air, in which direction and at which angle the discharge nozzle part of the at least one air discharger is tilted, a speed, an amount, and a pressure of the air to be discharged.

14. The control method of claim 13, wherein each of the plurality of air dischargers includes a plurality of discharge nozzle parts, and wherein during the air discharge according to the pre-mapped air discharge condition, less than all of the plurality of discharge nozzle parts of the at least one air discharger discharges air in order to avoid discharging air to the face of the person.

15. The control method of claim 13, wherein during the air discharge according to the pre-mapped air discharge condition, less than all of a plurality of discharge nozzle parts of the at least one air discharger discharge air and are tilted relative to a height direction of the at least one air discharger to face a preset direction.

16. The control method of claim 13, further comprising:

receiving, in a standby state of the hygiene management device, an input through a control panel of the hygiene management device;

outputting a guide voice for face registration to guide the person towards a second detector of the detector of the hygiene management device, the second detector including a face recognition camera;

detecting the face of the person, by the second detector, and storing an image of the face of the person in the memory of the hygiene management device; and displaying, in response to the detecting of the face of the person, a plurality of air discharge conditions on a display of the hygiene management device.

17. The control method of claim 16, further comprising:

receiving a selection of one of the plurality of air discharge conditions on the display;

storing the detected face with the selected air discharge condition in the memory; and controlling the plurality of air dischargers to discharge air according to the selected air discharge condition.

* * * * *